US010774580B2

(12) United States Patent
Sosa et al.

(10) Patent No.: US 10,774,580 B2
(45) Date of Patent: Sep. 15, 2020

(54) SYSTEM AND METHOD FOR IMPROVED LOUVER WINDOWS

(71) Applicant: GREEN STAR ENERGY LLC, Guaynabo, PR (US)

(72) Inventors: Ricardo A. Sosa, Guaynabo, PR (US); Kevin Nieves-Garcia, Guaynabo, PR (US)

( * ) Notice: Subject to any disclaimer, the term of this patent is extended or adjusted under 35 U.S.C. 154(b) by 0 days.

(21) Appl. No.: 16/149,512

(22) Filed: Oct. 2, 2018

(65) Prior Publication Data

US 2019/0032397 A1 Jan. 31, 2019

Related U.S. Application Data

(63) Continuation-in-part of application No. 14/990,154, filed on Jan. 7, 2016, now Pat. No. 10,087,677, which
(Continued)

(51) Int. Cl.
*E06B 7/10* (2006.01)
*E06B 3/08* (2006.01)
(Continued)

(52) U.S. Cl.
CPC ..... *E06B 7/10* (2013.01); *E06B 3/08* (2013.01); *E06B 3/263* (2013.01); *E06B 3/5036* (2013.01);
(Continued)

(58) Field of Classification Search
CPC . E06B 7/098; E06B 7/10; E06B 7/084; E06B 7/086; E06B 5/205; E06B 5/11;
(Continued)

(56) References Cited

U.S. PATENT DOCUMENTS 3,026,579 A * 3/1962 Carter ..... E06B 3/2605 49/62
3,210,003 A * 10/1965 Quinton ..... B60K 11/085 236/35.2
(Continued)

FOREIGN PATENT DOCUMENTS

KR 20110135474 A * 12/2011

OTHER PUBLICATIONS

Hwang, Yook; 2012; KR101117076 Machine translation, retrieved from https://worldwide.espacenet.com/publicationDetails/biblio?CC=KR&NR=101117076B1&KC=B1&FT=D&ND=1&date=20120222&DB=&locale= (Year: 2012).*

*Primary Examiner* — Katherine W Mitchell
*Assistant Examiner* — Abe Massad
(74) *Attorney, Agent, or Firm* — Eugenio J. Torres-Oyola; Victor M. Rodriguez-Reyes; Rafael Rodriguez-Muriel

(57) ABSTRACT

The system includes a series of operable louvers mounted on a four-sided frame and connected on each side to the operating mechanism that allows for easy opening and closing of the louvers. Every part of the system that is exposing to the exterior of the building is separated from the interior part of the system by a low heat conductivity material as a thermal barrier. Each operable louver is composing of a four-sided main frame, two panes of glass (inner and outer) and a coupling mechanism on each side that connects to the operating mechanism. The main frame acts as the thermal break as well as a system that absorbs the energy created when an outside object impacts the window from the outside. The system incorporates sealing devices between all moving parts to eliminate water and air infiltration. The operating system allows for easy opening and closing of the window by rotating each louver with the crank mechanism assisted by springs.

12 Claims, 27 Drawing Sheets

Related U.S. Application Data is a continuation-in-part of application No. 14/577,637, filed on Dec. 19, 2014, now abandoned.

(60) Provisional application No. 61/917,955, filed on Dec. 19, 2013.

(51) Int. Cl.

| | |
|---|---|
| ***E06B 3/263*** | (2006.01) |
| ***E06B 3/67*** | (2006.01) |
| ***E06B 5/20*** | (2006.01) |
| ***E06B 5/11*** | (2006.01) |
| ***E06B 5/12*** | (2006.01) |
| ***E06B 7/098*** | (2006.01) |
| ***E06B 3/66*** | (2006.01) |
| ***E06B 7/086*** | (2006.01) |
| ***E06B 3/50*** | (2006.01) |
| ***E06B 3/663*** | (2006.01) |
| *E05F 11/10* | (2006.01) |
| *E05F 15/622* | (2015.01) |
| *E05F 17/00* | (2006.01) |
| *E06B 7/23* | (2006.01) |

(52) U.S. Cl.

CPC ..... *E06B 3/6621* (2013.01); *E06B 3/66309* (2013.01); *E06B 3/6707* (2013.01); *E06B 5/11* (2013.01); *E06B 5/12* (2013.01); *E06B 5/205* (2013.01); *E06B 7/086* (2013.01); *E06B 7/098* (2013.01); *E05F 11/10* (2013.01); *E05F 15/622* (2015.01); *E05F 2017/008* (2013.01); *E05Y 2201/62* (2013.01); *E05Y 2800/353* (2013.01); *E05Y 2800/40* (2013.01); *E05Y 2900/10* (2013.01); *E05Y 2900/148* (2013.01); *E06B 3/26301* (2013.01); *E06B 3/66328* (2013.01); *E06B 3/66333* (2013.01); *E06B 3/66357* (2013.01); *E06B 7/2309* (2013.01); *E06B 2003/66385* (2013.01)

(58) Field of Classification Search

CPC ... E06B 5/10; E06B 3/08; E06B 3/263; E06B 3/6707; E06B 3/66328; E06B 3/66309; E06B 3/6621; E06B 3/5036; E06B 2003/66385; E06B 3/66357; E06B 3/66333; E06B 3/26301

See application file for complete search history.

(56) References Cited

U.S. PATENT DOCUMENTS

| | | | | | |
|---|---|---|---|---|---|
| 3,287,852 | A * | 11/1966 | Belden | E06B 7/084 | 49/87.1 |
| 4,855,716 | A * | 8/1989 | Jordal | E06B 7/086 | 340/550 |
| 4,889,040 | A * | 12/1989 | Man | E06B 7/082 | 454/224 |
| 5,560,147 | A * | 10/1996 | Ashida | E06B 7/086 | 49/403 |
| 6,098,339 | A * | 8/2000 | Rivera | E06B 7/086 | 49/73.1 |
| 6,363,660 | B1 * | 4/2002 | Saelzer | E06B 5/106 | 49/401 |
| 6,401,428 | B1 * | 6/2002 | Glover | E06B 3/24 | 52/786.1 |
| 7,335,096 | B2 * | 2/2008 | Perez | E04B 7/163 | 454/358 |
| 8,156,688 | B2 * | 4/2012 | Tan | E06B 7/084 | 49/403 |

* cited by examiner

SYSTEM AND METHOD FOR IMPROVED LOUVER WINDOWS

RELATED APPLICATIONS

This application is a Continuation-in-Part of U.S. Non-Provisional application Ser. No. 14/990,154, filed on Jan. 7, 2016, which is a Continuation-In-Part of U.S. Non-Provisional application Ser. No. 14/577,637, filed on Dec. 19, 2014, which claims the benefit of U.S. Provisional Application Ser. No. 61/917,955, filed on Dec. 19, 2013, all of which are hereby incorporated by reference in their entirety.

BACKGROUND OF THE DISCLOSURE

1. Field of the Invention

The present invention relates to a system and method for improved louver windows, and specifically to improved manufacture and efficiency processes of said assemblies.

2. Description of the Related Art

In response to the high levels of crime, economic, environment and energy crises, there is a clear need to create products that address them. It is imperative to address public, schools, universities, hospitals, shopping malls and other safety against terrorist attack by internal and external means. The above must be done while taking into account how indiscriminate residential and product entrapment installation of railings may obstruct emergency exits during events such as floods or fire. The challenge is product development capable of protecting human beings and injecting into the economy new jobs while improving our quality of life.

One such area for product development is dwelling windows. These require a window product that has stylized appearance combined with a conservative classic elegant look that blends into the landscape providing a sense of freedom, but at the same time incorporates the essential safety feature against theft, vandalism, tornadoes, hurricanes, sound, and other issues while placing energy disadvantages at the forefront of their beneficiaries.

SUMMARY OF THE INVENTION

The present invention relates to an operable louver window system that can protect a building from vandals (forceful entry), tornadoes, and hurricanes and meet the Energy Star requirements for all 4 zones of mainland USA. The uniqueness of this new product is that it can protect the building from vandals in a "closed" position (i.e., when the window is closed) as well as in an "open" position (i.e., when the window is open). In the "closed" configuration, the window will meet the thermal efficiencies required by the Energy Star certifications and the impact test requirements of the Unified Building Code 2012 (UBC). In the "open" configuration, it will allow for natural ventilation of the enclosed building and still protect the same against forceful entry.

This section is for the purpose of summarizing some aspects of the present invention and to briefly introduce some preferred embodiments. Simplifications or omissions may be made to avoid obscuring the purpose of the section. Such simplifications or omissions are not intended to limit the scope of the present invention.

All references, including any patents or patent applications cited in this specification are hereby incorporated by reference. No admission is made that any reference constitutes prior art. The discussion of the references states what their authors assert, and the applicants reserve the right to challenge the accuracy and pertinence of the cited documents. It will be clearly understood that, although a number of prior art publications are referred to herein, this reference does not constitute an admission that any of these documents form part of the common general knowledge in the art.

It is acknowledged that the term 'comprise' may, under varying jurisdictions, be attributed with either an exclusive or an inclusive meaning. For the purpose of this specification, and unless otherwise noted, the term 'comprise' shall have an inclusive meaning—i.e. that it will be taken to mean an inclusion of not only the listed components it directly references, but also other non-specified components or elements. This rationale will also be used when the term 'comprised' or 'comprising' is used in relation to one or more steps in a method or process.

One aspect of the invention is about an apparatus comprising one or more monobloc glass louvers, one or more chromoly bars, and an integrated operator shifter comprised of a compact assembly. In more detail, an embodiment of the invention comprises a window frame having upper, lower, left and right walls, a plurality of chromoly bars for increased security, a plurality of louvers extending from the left wall to the right wall of the window frame, the plurality of louvers being rotatable about a parallel axis, a drive coupling extending from at least one side of each of the plurality of louvers so as to allow synchronous rotation of the plurality of louvers about the parallel axis, an operating bar within at least one the left wall or right wall of the window frame, the operating bar being connected with the drive coupling in each of the plurality of louvers and, an operator shifter comprising a window opening assisting mechanism coupled to the operating bar, said assisting mechanism providing an angular displacement with respect to the operating bar, a distant holder coupled to the operating bar, a biasing device having an upper and a lower side, the upper and lower side of the biasing device operatively coupled to the assisting mechanism and the distant holder, respectively, and, a handle bar operatively coupled to the operating bar.

Other features and advantages of the present invention will become apparent upon examining the following detailed description of an embodiment thereof, taken in conjunction with the attached drawings.

Figure 1A:
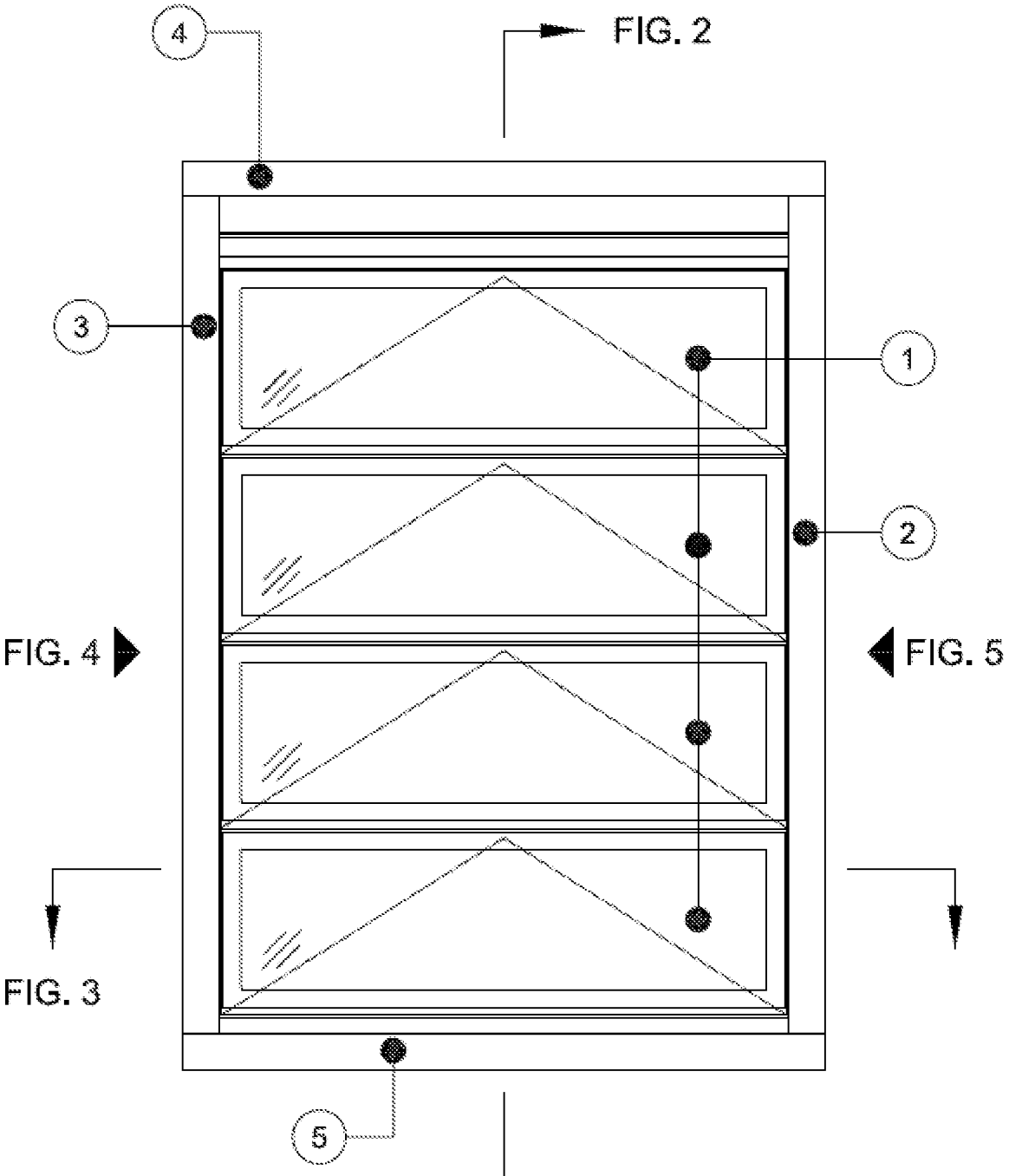
FIG. 1A-1B are exemplary views of the structure of the first preferred embodiment in accordance with the principles of the present invention.

The above-described and other features will be appreciated and understood by those skilled in the art from the following detailed description, drawings, and appended claims.

DETAILED DESCRIPTION OF THE PREFERRED EMBODIMENT

To provide an overall understanding of the invention, certain illustrative embodiments and examples will now be described. However, it will be understood by one of ordinary skill in the art that the same or equivalent functions and sequences may be accomplished by different embodiments that are also intended to be encompassed within the spirit and scope of the disclosure. The compositions, apparatuses, systems and/or methods described herein may be adapted and modified as is appropriate for the application being addressed and that those described herein may be employed in other suitable applications, and that such other additions and modifications will not depart from the scope hereof.

Certain terminology is used in the following description for convenience only and is not limiting. The words "lower," "upper," "bottom," "top," "front," "back," "left," "right" and "sides" designate directions in the drawings to which reference is made, but are not limiting with respect to the orientation in which the modules or any assembly of them may be used.

Figure 1B:
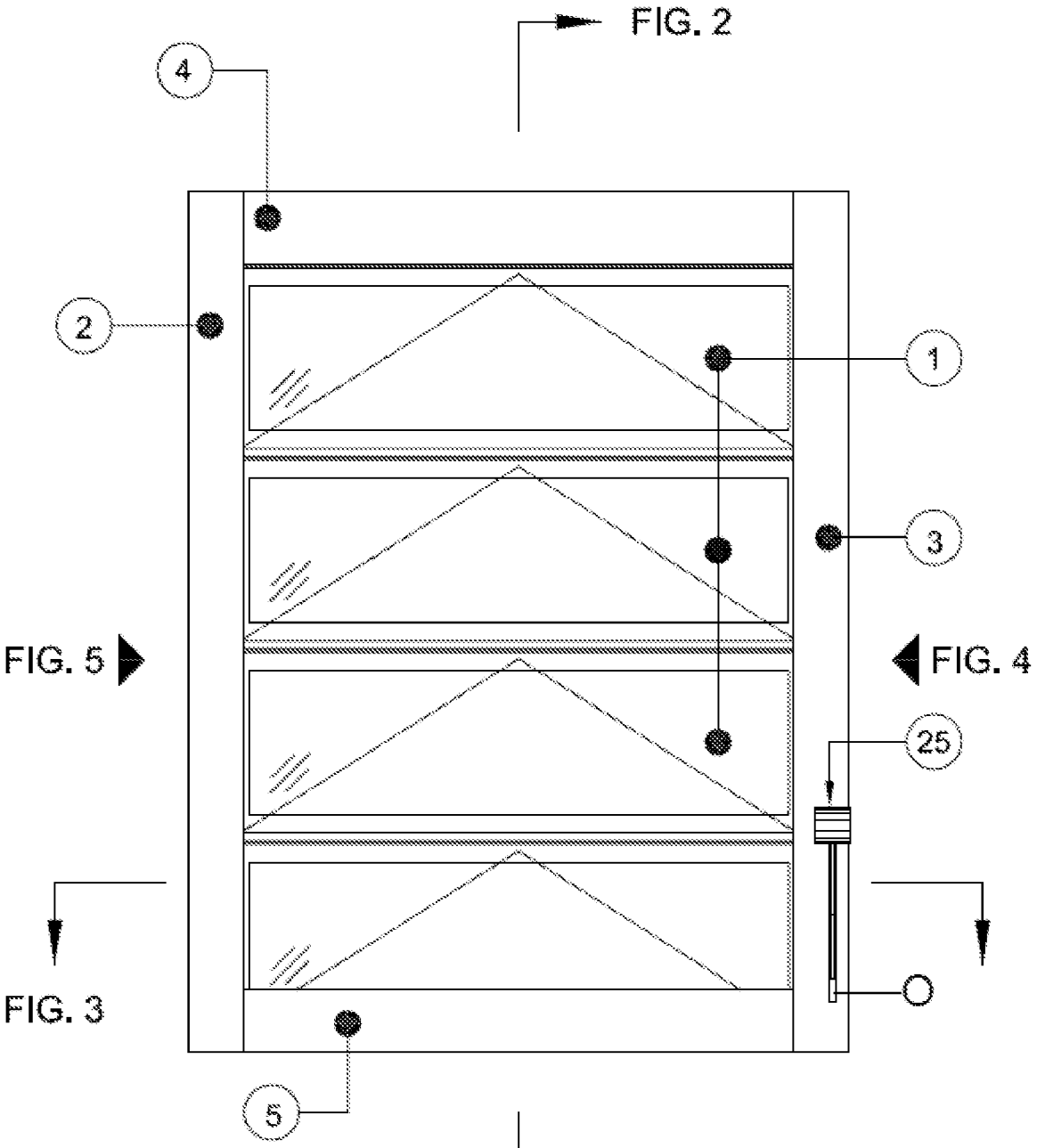

FIG. 1A is directed to a front exemplary view of the structure of the first preferred embodiment in accordance with the principles of the present invention. The front view represents the portion of the window that is exposed to the outdoor. FIG. 1B is directed to a back exemplary view of the structure of the first preferred embodiment in accordance with the principles of the present invention; the back view represents the portion of the window that is located inside the building structure. The first embodiment comprises a housing, wherein said housing comprises a top fame part 4, a first side frame part 3, a second side frame part 2 and a bottom frame part 5. Further the first embodiment comprises at least a louver 1 and operator system (described in details below). The louver 1 is mechanically coupled to the operator system in order to rearrange and/or provide angular displace of the louver. The term "mechanically coupled" is intended to include the attachment of two or more elements using a third element, such as rivet, to at least maintain a constant connection between said two or more elements. In this context, the term "mechanically coupled" is used to mean coupled together so as to be able to transmit rotation or displacement of an element, such as is the case when elements are connected to a travel bar by rivets. As mentioned above, an object of the present disclosure is to provide a compact, efficient and convenient system that reduces the effort, time in operation and being virtually unbreakable. The operator system is configured to provide a system that reduces effort and operation time. The operator system operates without a complex mechanical connection between parts, which allows the system to take advantage of natural leverage point mechanism reducing the force required for operation without increasing the length of the lever. In an alternate embodiment, the equipment may have simultaneous optional manual or automatic operation. As shown in FIG. 1, FIG. 2 through FIG. 5 are exploded views of the marked sections per figure. The purpose is to provide a more detailed view of each part and respective elements.

Figure 2:
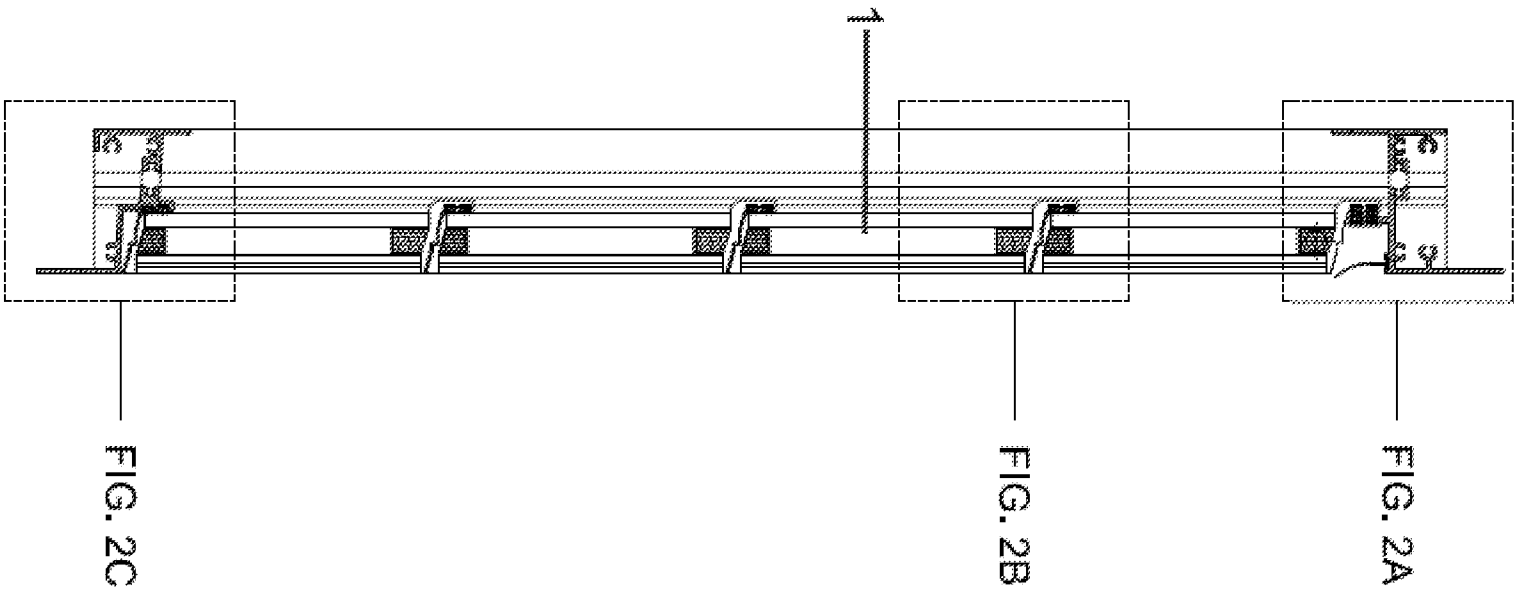
FIG. 2 is a vertical cut-out section of FIG. 1 of the structure of the first preferred embodiment in accordance with the principles of the present invention.

FIG. 2 is directed to the first embodiment side view, and more particularly, to the part of the second side frame. FIG. 2 is further divide into FIG. 2A, FIG. 2B and FIG. 2C for purpose of a better understanding of the present disclosure. FIG. 2 provides a top second side frame view as disclosed by FIG. 2A, a middle second side frame view as disclosed by FIG. 2B, and a bottom second side frame view as disclosed in FIG. 2C.

Figure 2A:
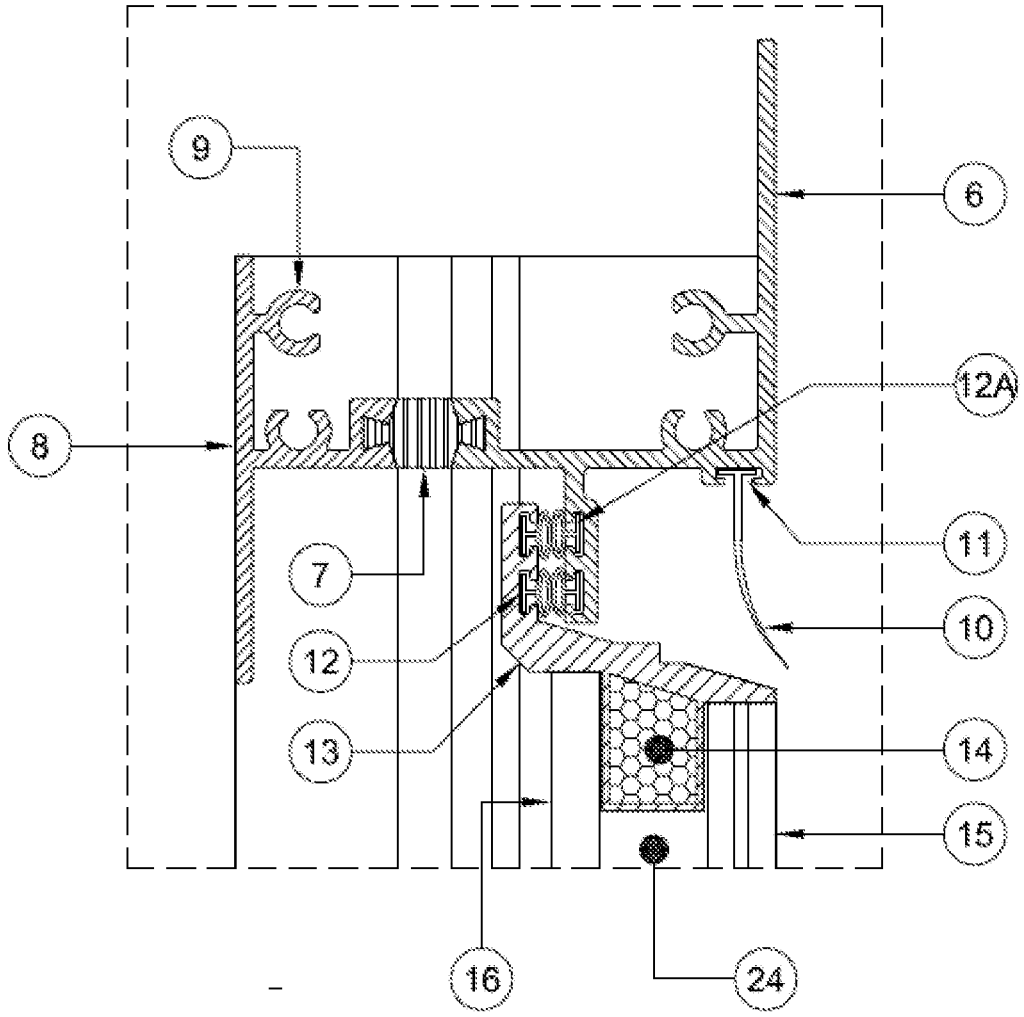
FIG. 2A-2C are exemplary exploded view of the cut-out section of FIG. 1 of the structure of the first preferred embodiment in accordance with the principles of the present invention

The top second side frame 4, as shown in FIG. 2A, comprises an outer frame 6, heat transfer barrier 7, inner frame 8, attachment receivers 9, environmental barrier 10, environmental barrier receiver 11 and seal 12 a. The heat barrier 7 is mechanically coupled between the outer frame and inner frame to avoid heat transfer between said parts. The outer frame and inner frame comprises attachment receivers 9. The attachment receiver assists in attaching properly the top frame part 4 with the second side frame part. The outer frame further comprises a protrusion that holds at least a seal 12 a. The seal in preferably made of rubber material that is flexible and withstand weather changes (i.e. cold weather and hot weather). As shown the louver 1 is in contact with the outer frame 6 by means of a sealer 12 which is couple to the top louver frame 13. The louver 1 comprises a honeycomb structure integrally made with the top louver frame 13. The louver 1 also includes a first face 15, a middle section 24 and a back face 16 which are explained in detail below.

Figure 2B:
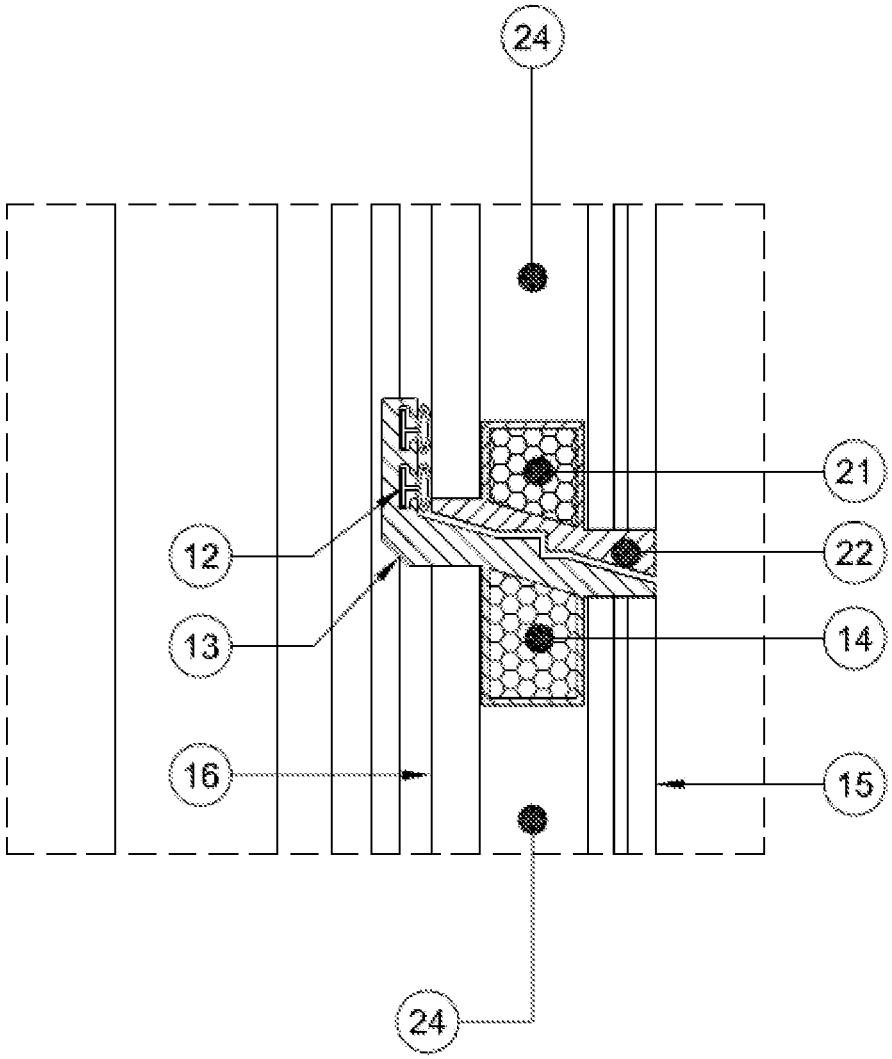

FIG. 2B is directed to middle second side frame view. It is important to understand that several louvers 1 may be employed with the system. Therefore, when more than one louver 1 is used a mechanism is provided to seal the connection between louvers 1. For example, as shown in FIG. 2B, a seal 12 is provided with the top louver frame 13 to seal the connection between louvers 1. Further, the top louver frame 13 and bottom louver frame 22 are shaped to match in such way that when an adjacent louver rotates to a vertical position, with respect to the bottom frame part 5, the seal attach to the top louver frame 13 end in close contact with the back face 16. FIG. 2B also shows the shape 21 of the honeycomb structure 14 integrated to the bottom louver frame part 22. Its function is to absorb impact at the moment that the first face glass 15 requires impact.

Figure 2C:
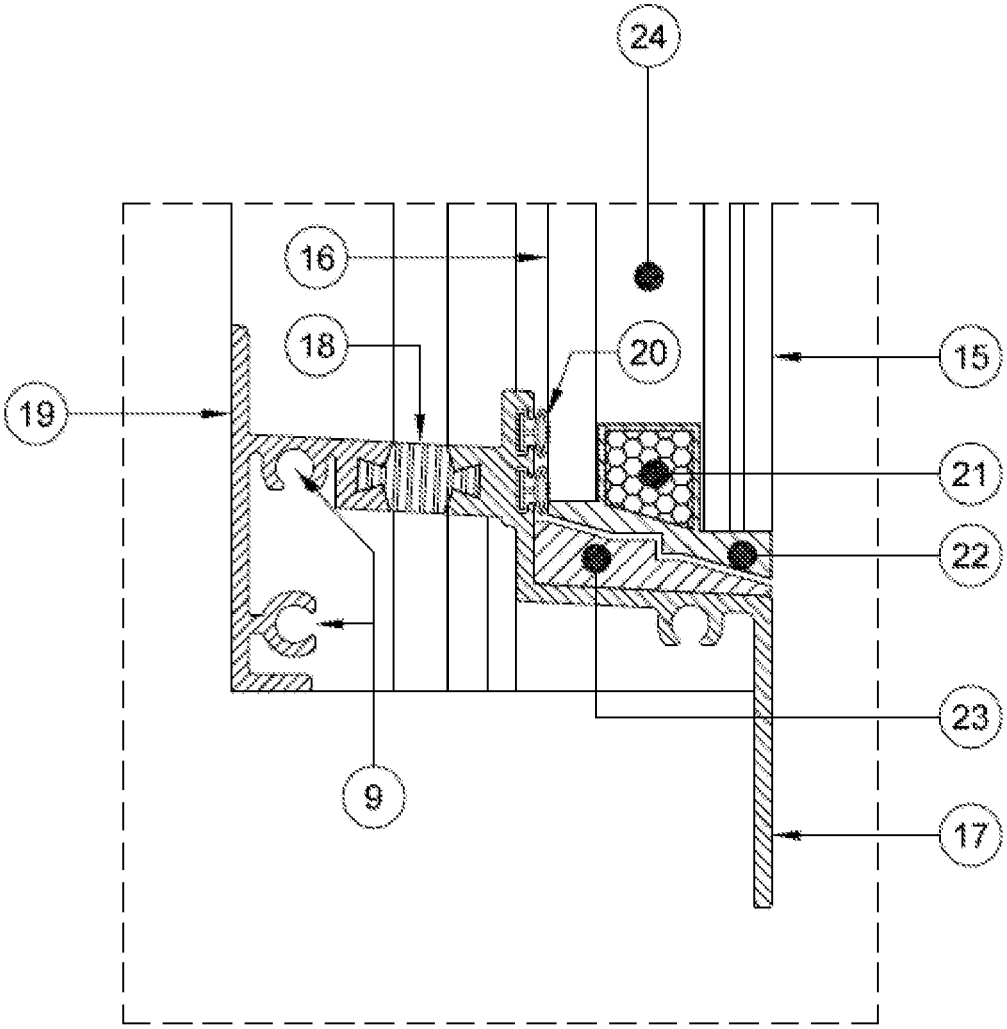

FIG. 2C is directed to the bottom second side frame view, which is approximately similar in function to FIG. 2A, comprising an outer frame 17, heat transfer barrier 18, inner frame 19, attachment receivers 9 and seal 20. The heat barrier 18 is attached between the outer frame 17 and inner frame 19 to avoid heat transfer between said parts. The outer frame and inner frame comprises attachment receivers 9. A seal 20 is coupled to the outer frame 17. Further the outer frame 17 comprises a second seal. The second seal is made of the same material as the bottom louver frame 22. The second seal is configured to receive and match the shape of said bottom louver frame 22. FIG. 2C further shows a solid structure 23 with the opposite shape of the bottom louver frame part 22 to create coupling in the lower part of the slat and the bottom louver frame 22.

Figure 3:
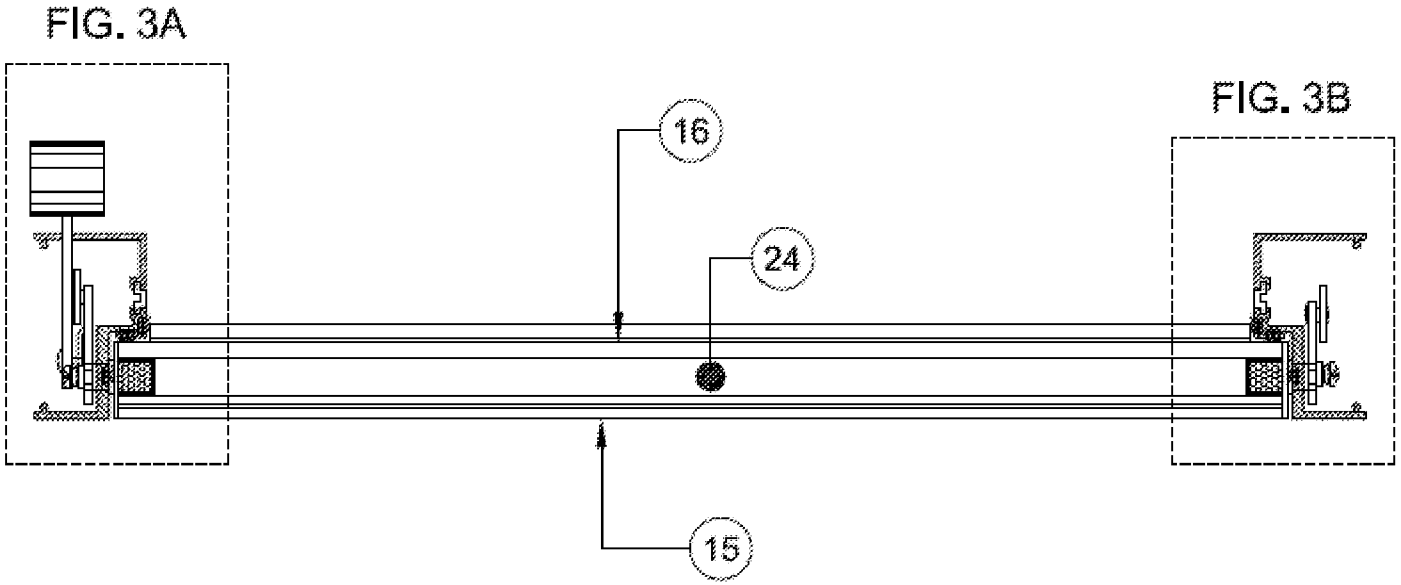
FIG. 3 is a horizontal cut-out section of FIG. 1 of the structure of the first preferred embodiment in accordance with the principles of the present invention.
Figure 3A:
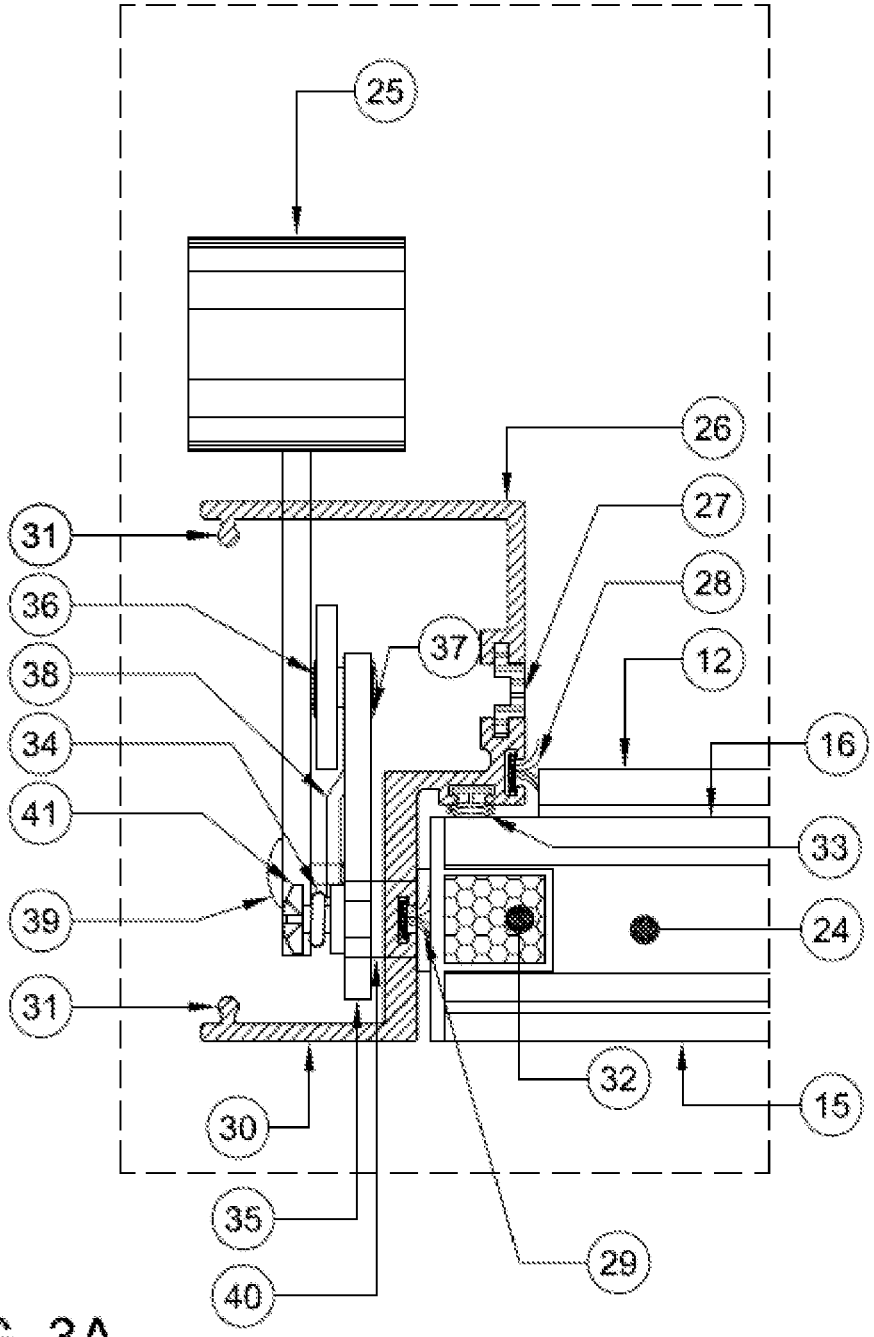
FIG. 3A-3B are exemplary exploded view of the cut-out section of FIG. 1 of the structure of the first preferred embodiment in accordance with the principles of the present invention
Figure 3B:
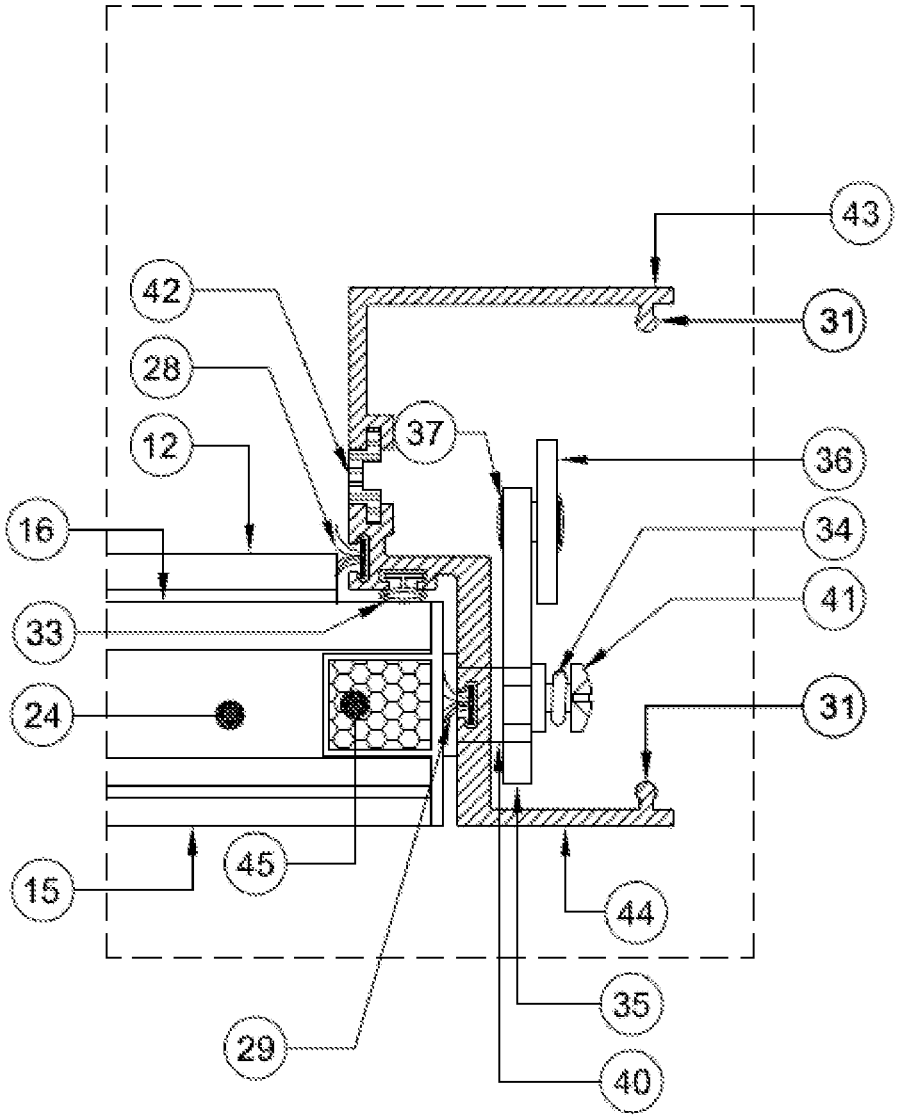

FIG. 3 is directed to the operator system coupled to the louver 1. As shown, in FIG. 3A, the operator system comprises a shifter 25 and several elements (explained below) coupled to the louver 1, more particularly the louver side frame 2,3. The inner frame 26 is coupled to outer frame 30 by a heat transfer barrier 27. The outer frame comprises an outer hole, an inner environmental barrier 28, outer environmental barrier 29 and first vertical sealer 33. The inner environmental barrier 28 serves as a barrier for dust and other element while the outer environmental barrier 29 provides the same protection from the outside dust. The inner frame 26 and outer frame 30 comprises a frame attachment 31. The frame attachment 31 extends vertically and it is used to attach more than one housing of the present disclosure. The louver 1, as shown, is hold between the side frames 2, 3. The louver attachment 57, disclosed below, passes through the outer frame hole and is supported by the crank 35. The bearing portion 54 of the louver attachment 57 is in contact with the outer hole surface, in such way that hold the louver on a particular vertical position with respect to the bottom part 5; and simultaneously allows the rotational displacement of the louver 1. FIG. 3A further shows that a rivet 37 joins travel bar 36 with crank 35. This can also be seen in FIG. 4A. Additionally, FIG. 3A shows plastic element 40, which is used to separate elements the outer frame 30 and the crank 35, thus avoiding friction between them. Similarly, as shown in FIG. 3B, the louver 1 is coupled to the inner frame 43 by the operator system, which is explained below. The inner frame 43 is coupled to outer frame 44 by a heat transfer barrier 42. The outer frame 44 comprises an inner environmental barrier 28, outer environmental barrier 29 and another first vertical sealer 33. The first vertical sealer extends vertically on said second frame part 2 and first side frame part 3.

Figure 4:
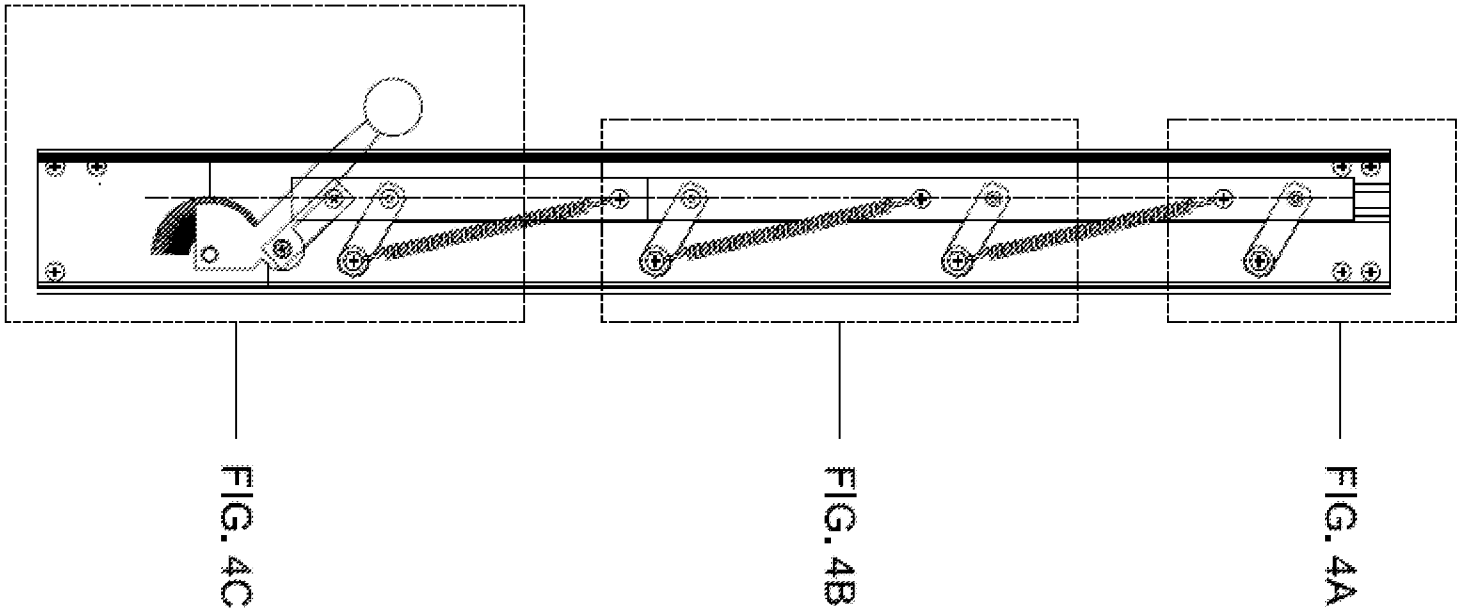
FIG. 4 is an exemplary view of the opening mechanism with actuator on a first lateral side of the first preferred embodiment in accordance with the principles of the present invention.
Figure 4A:
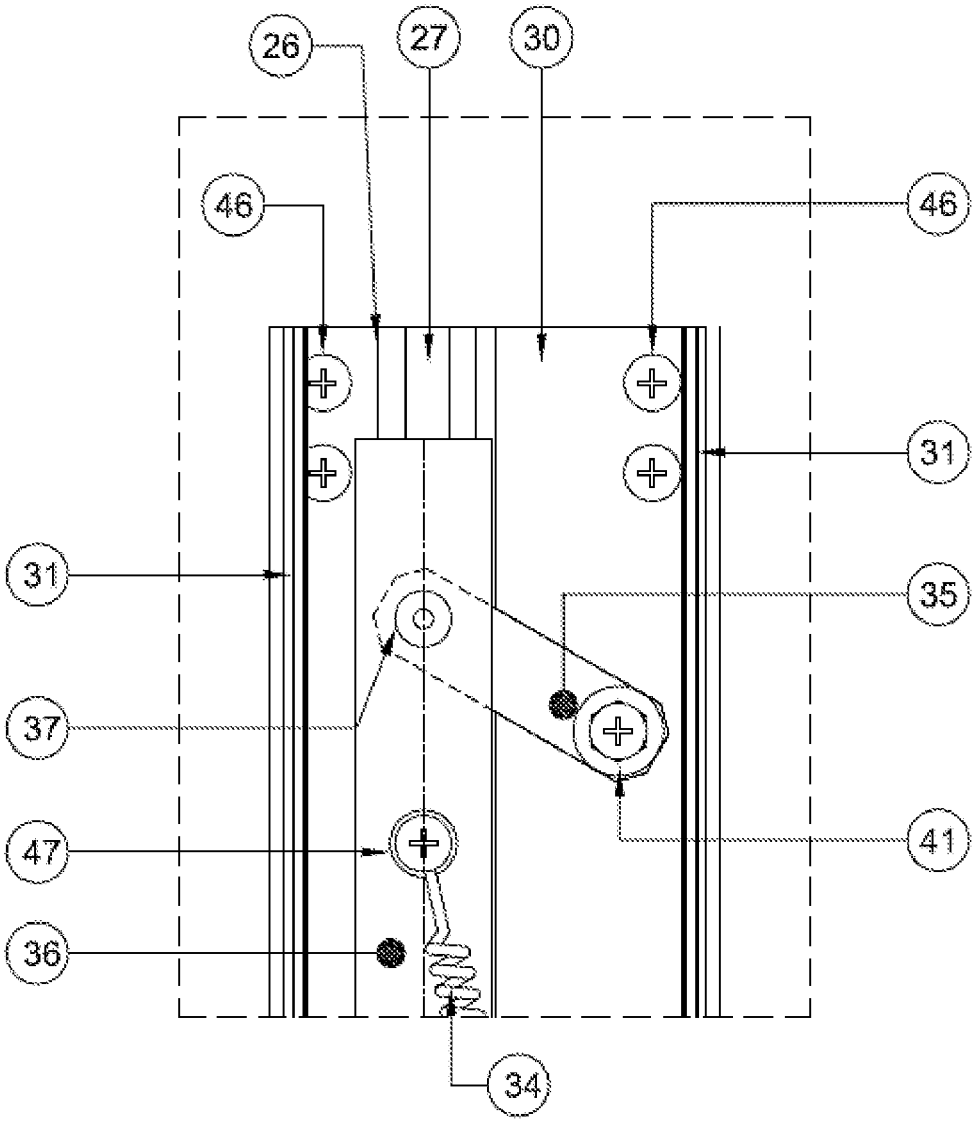
FIG. 4A-4C are exemplary exploded view of the opening mechanism on a first lateral side of the first preferred embodiment in accordance with the principles of the present invention.
Figure 4B:
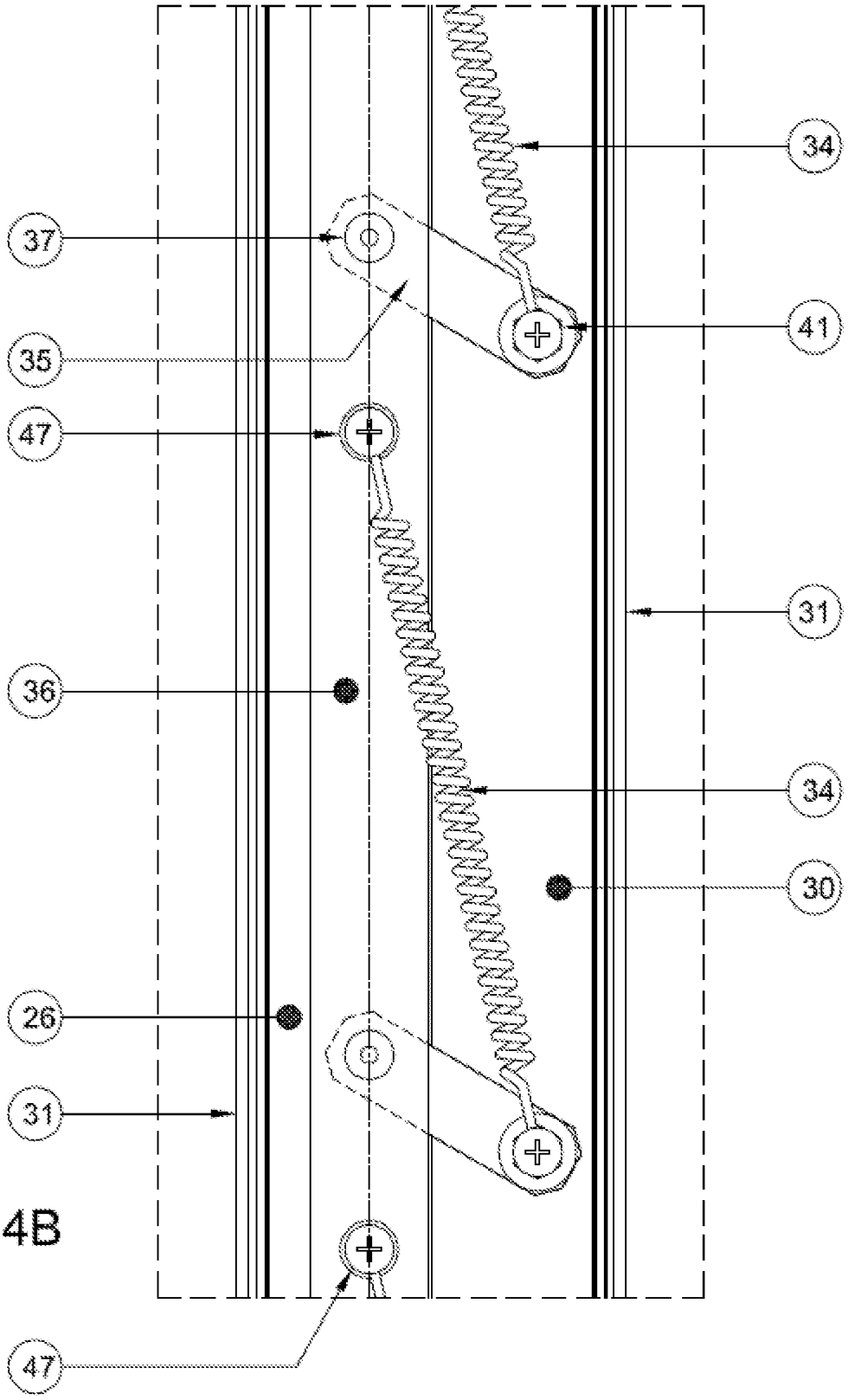
Figure 4C:
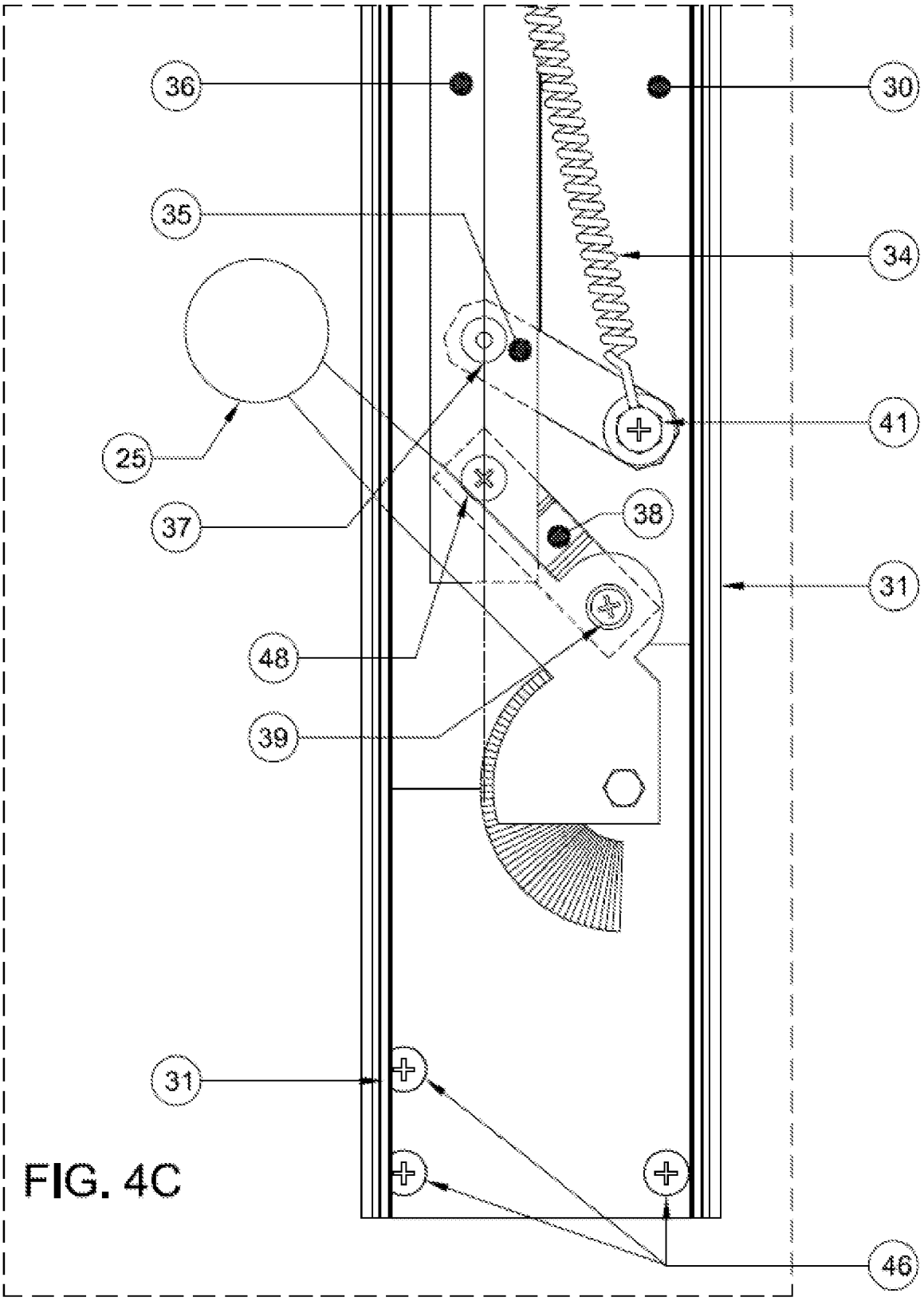

Mainly the operator system, which manages the displacement of the louvers 1, is located inside the first side frame part 3 and second side frame part 2. FIG. 4 is directed to the operator system located at the first side frame part 3, more particularly the side with the actuator or shifter 25, wherein said FIG. 4 is divided into at least three exploded views, as shown in FIG. 4A, FIG. 4B and FIG. 4C, for a better understanding of the operator system. The top part of the operator system, as shown in FIG. 4A, comprises a travel bar 36, a crank 35 and at least an elastic member 34. The elastic member, such as spring, comprises at least two ends wherein at least one of those ends is mechanically coupled to the travel bar 36 and a second end is coupled to the louver 1, more particularly the louver attachment 57. The crank 35 further comprises two ends, wherein one end is mechanically coupled to the travel bar 36 and the other end is attached to the louver attaching element 57 by means of attachment element 41, such as screw. FIG. 4B is directed to the middle section of the operator system. As shown the second end of the crank 35 is coupled to the elastic member 34 and the louver attachment 57. FIG. 4C is directed to the bottom part of the operator system. The operator system comprises a shifter 25. The shifter extends inside the housing as is coupled to the travel bar 36 by means of a transmitter bar 38. Any action or force applied to the shifter is transferred to the travel bar by means of the transmitter bar 38. The transmitter bar 38, which made of a solid structure capable of retain its body length without deformation, comprises at least one end coupled to the shifter by an attaching element 39 and a second end coupled to the travel bar 36 by another attaching element 48. The shifter comprises a traveling path which assists the rotational displacement of the shifter 25. The traveling path serves as a ratchet mechanism to hold the shifter in a particular position of the radial body of the travel path. The first frame part 3 comprises an opening O providing enough space for the linear displacement, with respects to the first frame part 3, of the shifter 25. The opening O maybe covered with a material to avoid dust to get inside the first frame part 3. Further on the top part and bottom part of the side frame comprises several attaching elements 46 used to fix the second side frame part 2 to the bottom frame part 5 and top frame part 4. The attaching elements 46 are coupled to the attachment receiving ends 9.

Figure 5:
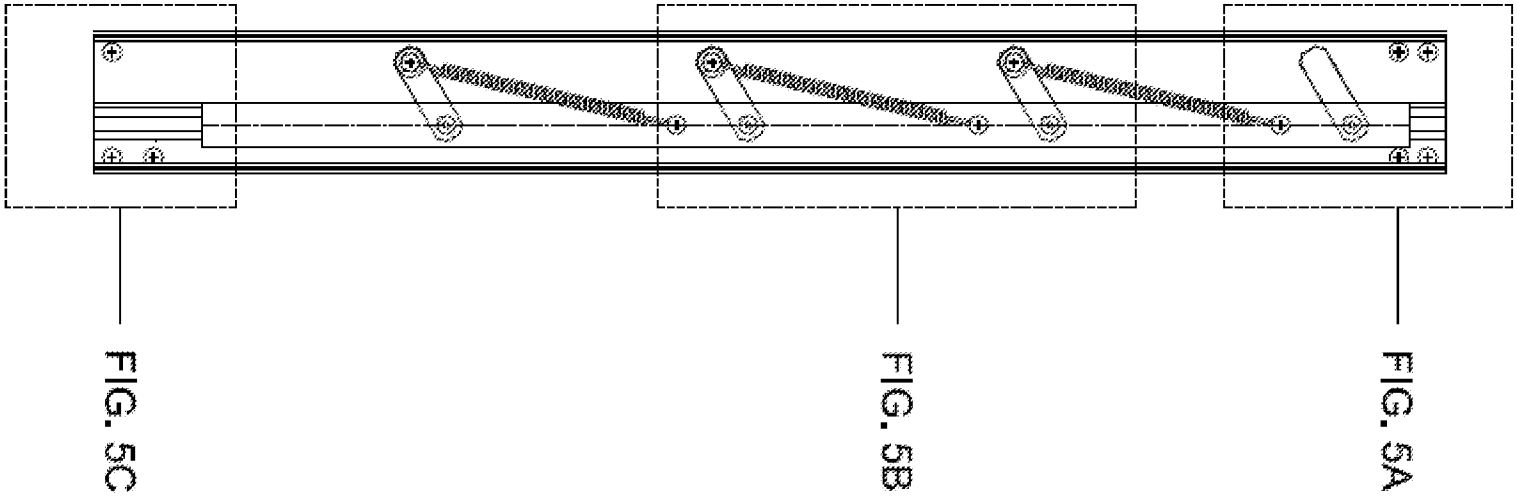
FIG. 5 is an exemplary view of the opening mechanism with actuator on a second lateral side of the first preferred embodiment in accordance with the principles of the present invention.
Figure 5A:
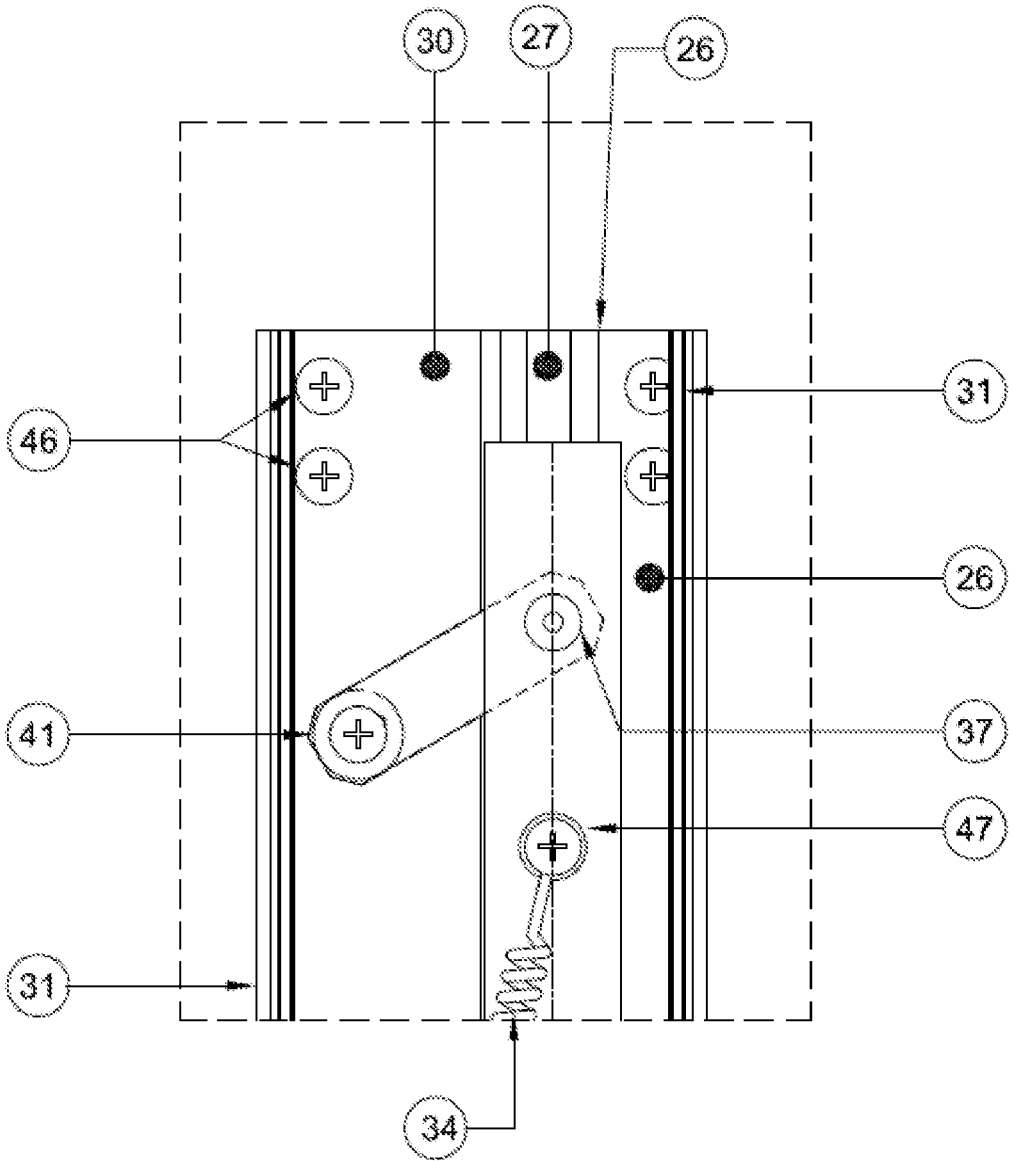
FIG. 5A-5C are exemplary exploded view of the opening mechanism on a first lateral side of the first preferred embodiment in accordance with the principles of the present invention.
Figure 5B:
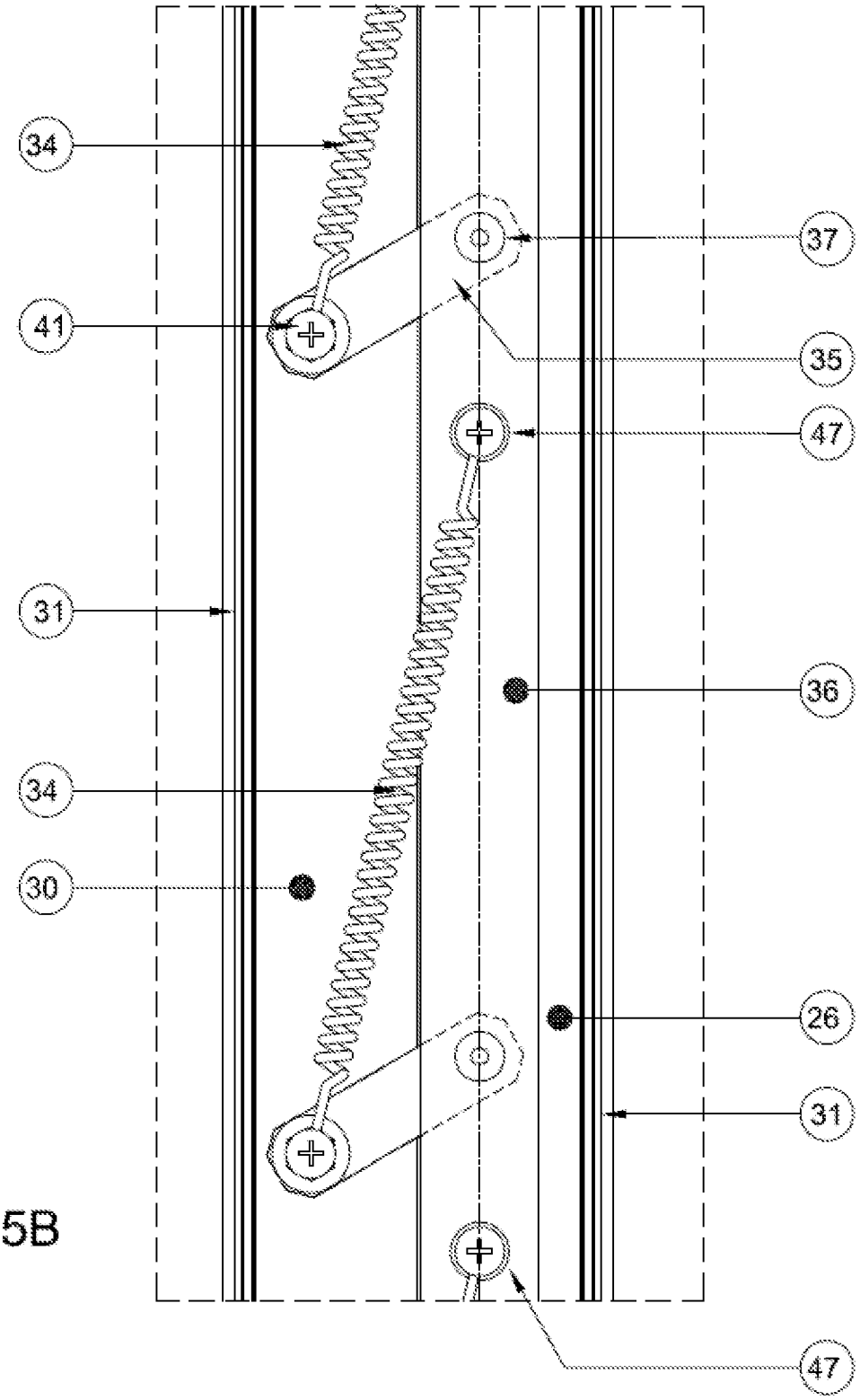
Figure 5C:
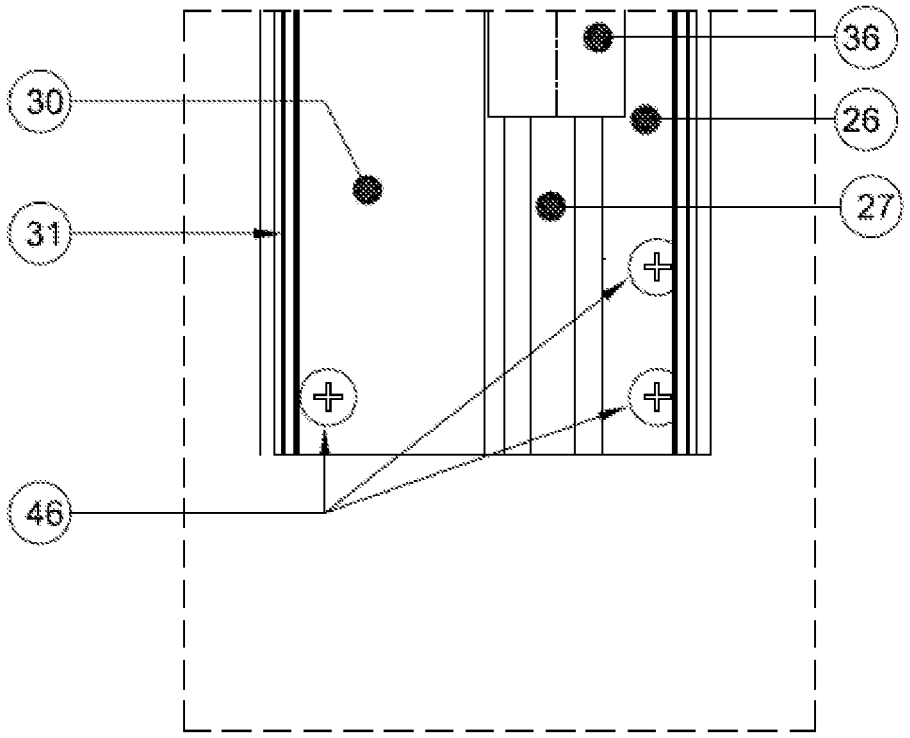

FIG. 5 is directed to the operator system located at the second side frame part 2, more particularly the side without the actuator or shifter 25, wherein said FIG. 5 is divided into at least three exploded views, as shown in FIG. 5A, FIG. 5B and FIG. 5C, for a better understanding of the operator system. Similar to FIG. 4A, the operator system, as shown in FIG. 5A, comprises a travel bar 36, a crank 35 and at least an elastic member 34. The elastic member comprising at least two ends wherein at least one of those ends is mechanically coupled to the travel bar 36. The crank 35 further comprises two ends, wherein one end is mechanically coupled to the travel bar 36 and the other end is fixed the louver 1 by means of attachment means 41, such as screw.

In one embodiment, a spring connected to the synchro bar will neutralize the weight of the slats further, reducing the operating force required which is an ADA recommendation when the system is used by persons with disabilities. The spring is coupled with a window opening assisting mechanism having an angular displacement that shifts the linear force exerted by the spring on the operating bar or travel bar. When the window is fully closed, the spring's tension aids in keeping the slats sealed and serves as a security feature. When the slats are open, the assisting mechanism shifts the force exerted by the spring's tension and serves to equalize the weight of the slats so as to ensure that they are not forcefully closed by an external force. It will be understood that the assisting mechanism is coupled to the spring in such a way that the spring's maximal force is used to seal the slats when the window is closed. When the assisting mechanism displaces angularly, the spring adjusts its tension to equalize the weight of the slats while the assisting mechanism causes the exerting force to shift in the opposite direction, therefore keeping the windows open. In yet another embodiment, simultaneous operation manually, automatically or semi-automatically (i.e. hybrid) would allow a hybrid configuration that provides both options manually or automatically fully to be effective in unison.

Figure 6:
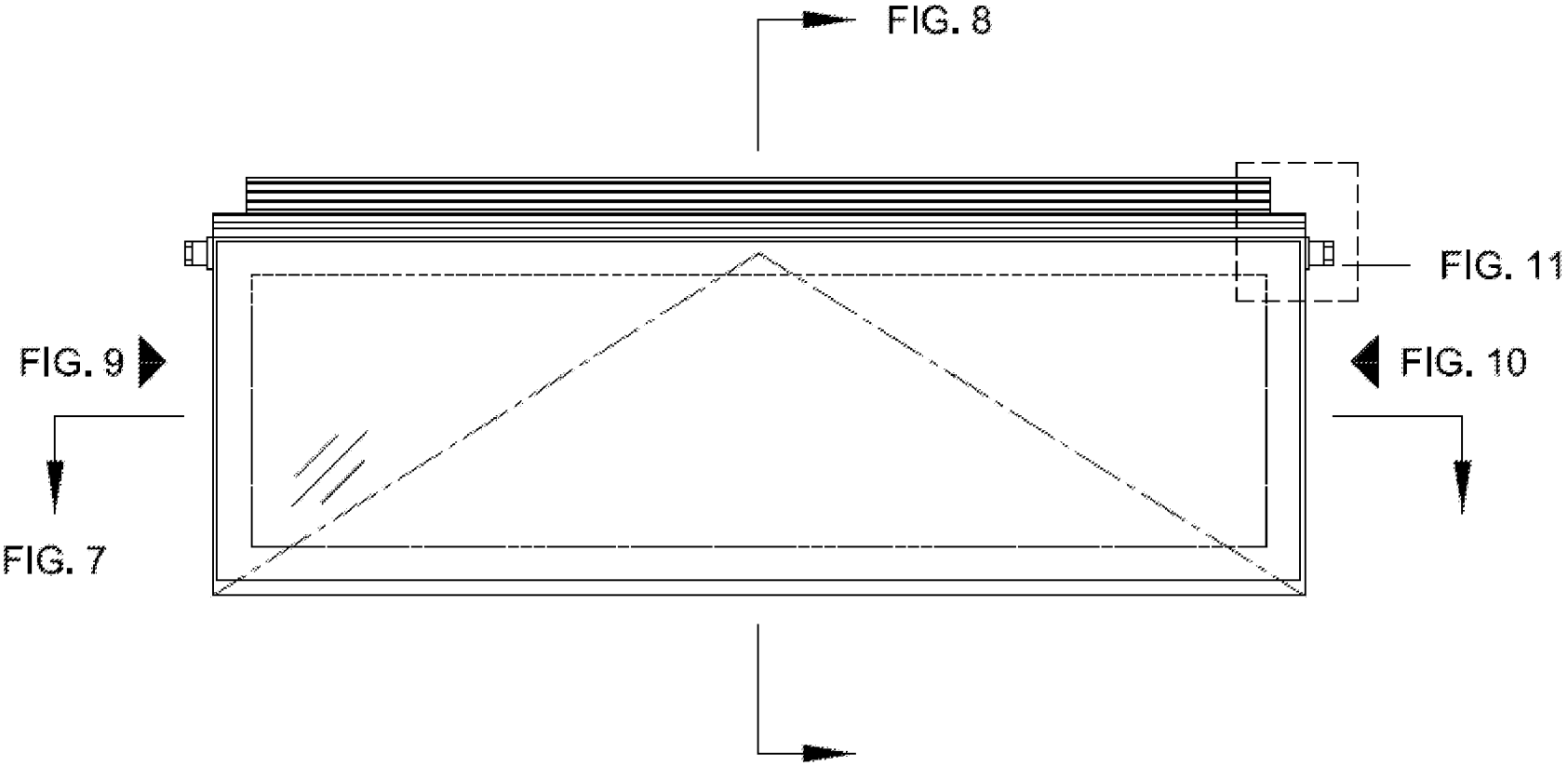
FIG. 6 is an exemplary view of the louver's structure of the first preferred embodiment in accordance with the principles of the present invention.
Figure 7:
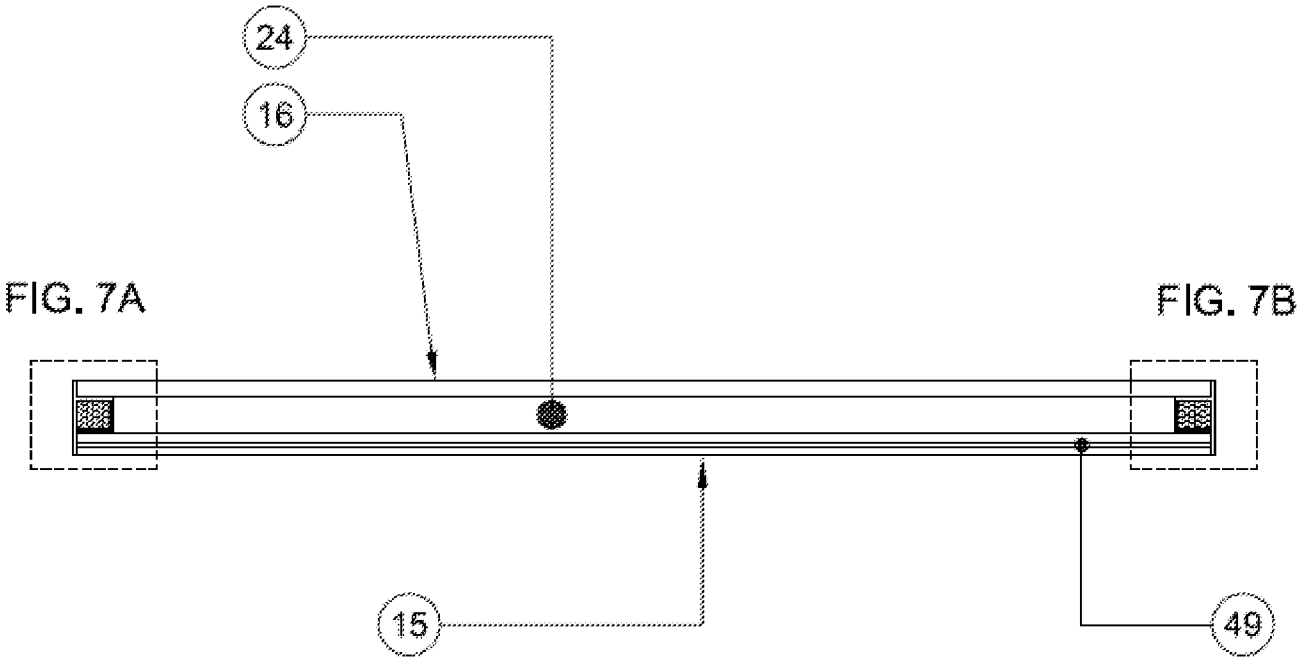
FIG. 7 is a horizontal cut-out section of FIG. 6 of the louver's structure of the first preferred embodiment in accordance with the principles of the present invention.
Figures 7A, 7B:
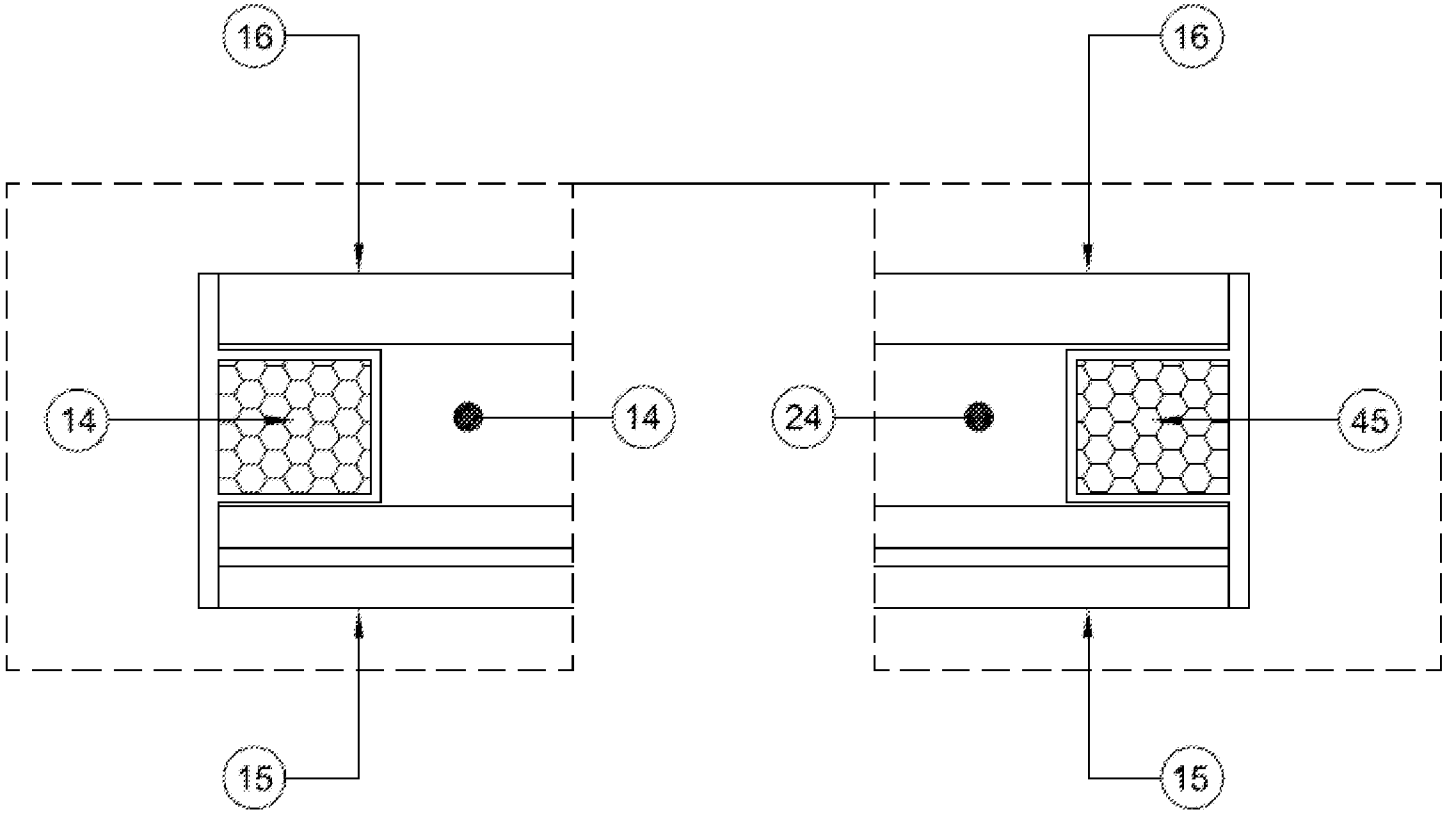
FIG. 7A-7B are exemplary exploded view of the cut-out section of FIG. 6 of the louver's structure of the first preferred embodiment in accordance with the principles of the present invention.

FIG. 6 through FIG. 11 are directed to the louver assembly. FIG. 6 is directed to an exemplary view of the structure of the first preferred embodiment for the louver 1 in accordance with the principles of the present invention. The louver 1 comprises a main frame, louver attachment elements 57, a first face glass 15, a middle section 24, and a second face glass 16. The main frame is made of a monolithic structure comprising a top louver frame part 13, bottom louver frame part 22, first side louver frame part 32 and a second side louver frame part 45. Further an impact absorbing structure is integrally made with the main frame. The impact absorbing structure, such as a honeycomb structure 14, extends towards the inner body of the louver 1. As shown in FIG. 7 the main frame supports the first face 15, an inner layer 49, a middle section 24 and second face 16. As clearly shown in FIG. 7A and FIG. 7B, the first face 15 and second face surrounds the honeycomb 14, while the middle section 24 is delimited by the honeycomb 14 structure.

Figure 8:
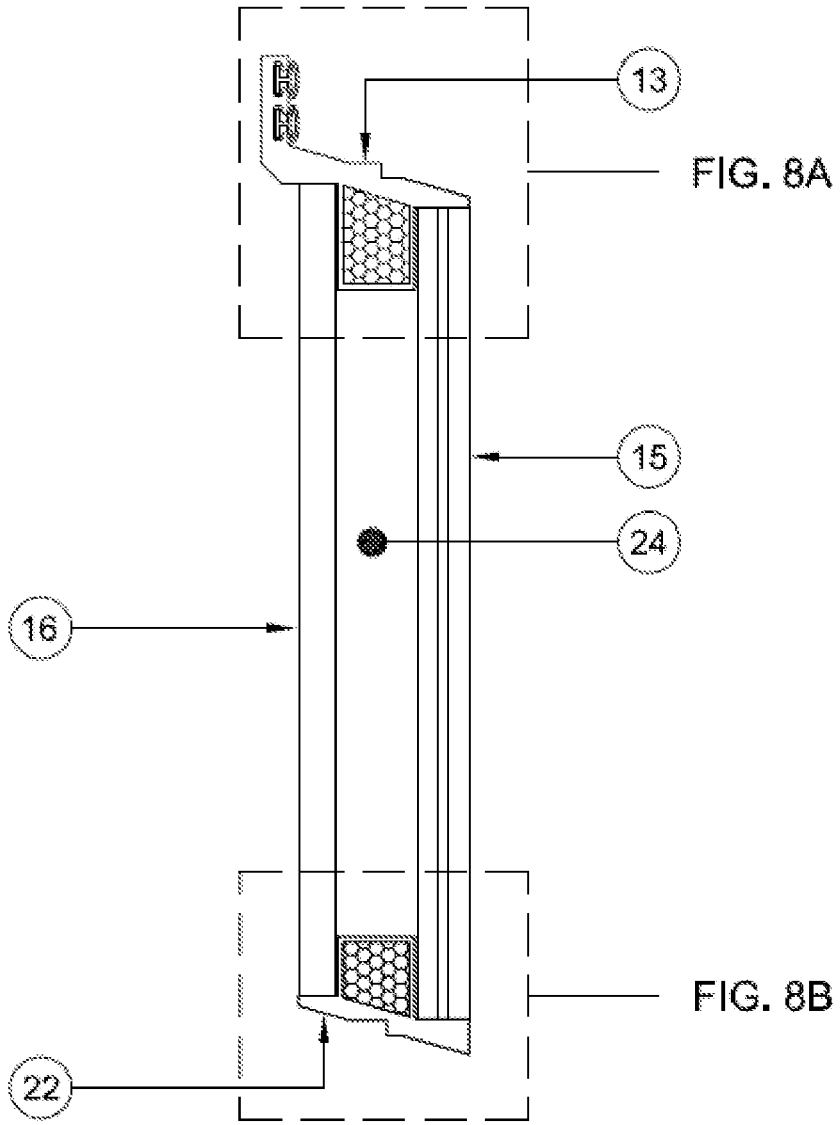
FIG. 8 is a vertical cut-out section of FIG. 6 of the louver's structure of the first preferred embodiment in accordance with the principles of the present invention.
Figure 8A:
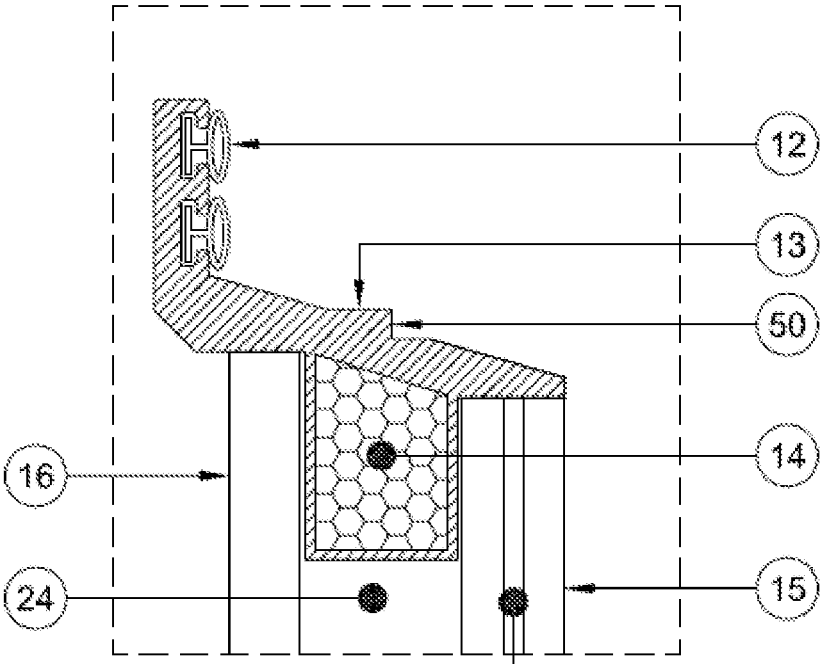
FIG. 8A-8B are exemplary exploded view of the cut-out section of FIG. 6 of the louver's structure of the first preferred embodiment in accordance with the principles of the present invention.
Figure 8B:
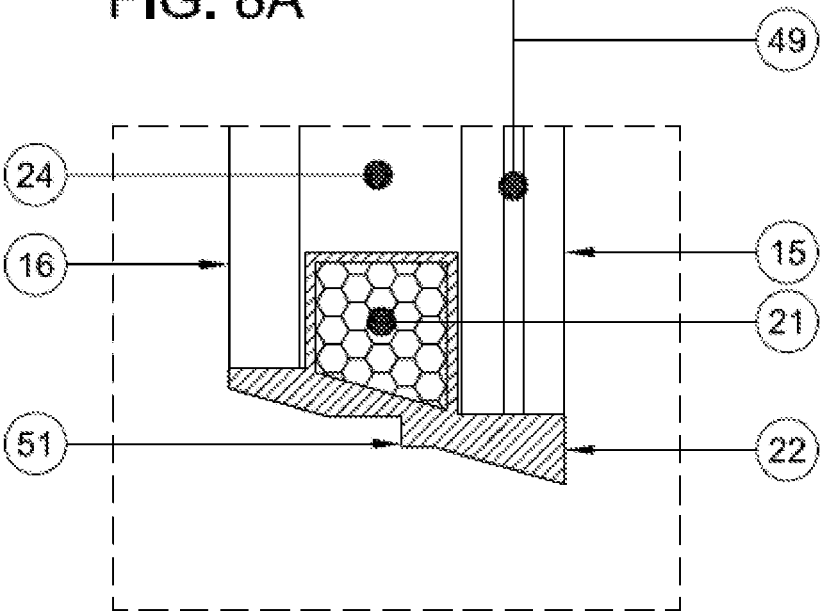

As shown in FIG. 8, the main frame comprises a top frame 13 and a bottom frame 22. FIG. 8A discloses the top frame 13, which as explained above, comprises the sealer 12. The first face comprises an inner resistance layer 49 preferably made of a translucent and/or transparent resistance material to withstand several projectiles that hit the first face 15. Thus, the thermal honeycomb brake 14 as shown in FIGS. 8A and 8B, similar to the main fame is preferably made of a material that insulates thermal conductivity and sound convection between the outside and inside of the window louver. This new thermal honeycomb brake 14 allows a solid platform which increases thermal resistance, energy efficiency, climate attributes and sound attenuation. FIGS. 8A and 8B also show that the coupling 50 and 51 between the top louver frame 13 and bottom louver frame 22 is shaped like a step (i.e., step-shaped).

Figure 9:
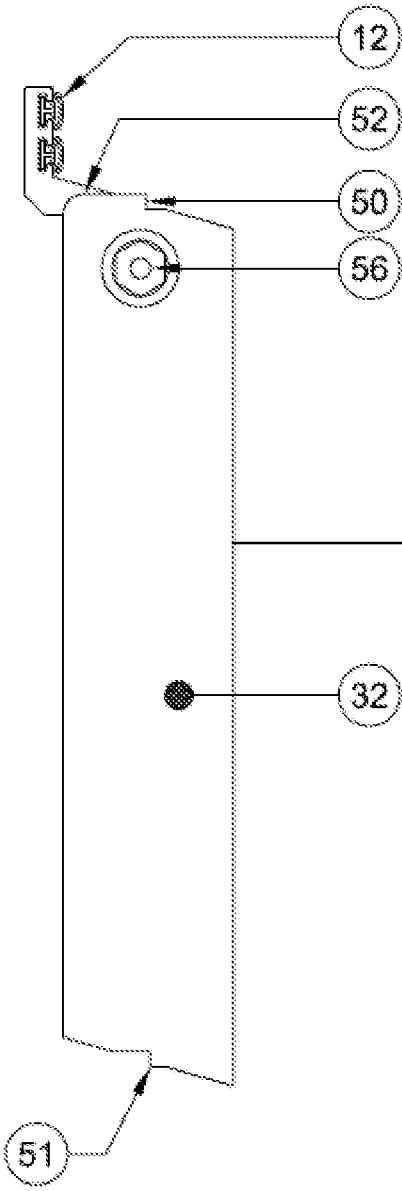
FIG. 9 is an exemplary left side view of the louver's structure of the first preferred embodiment in accordance with the principles of the present invention.
Figure 10:
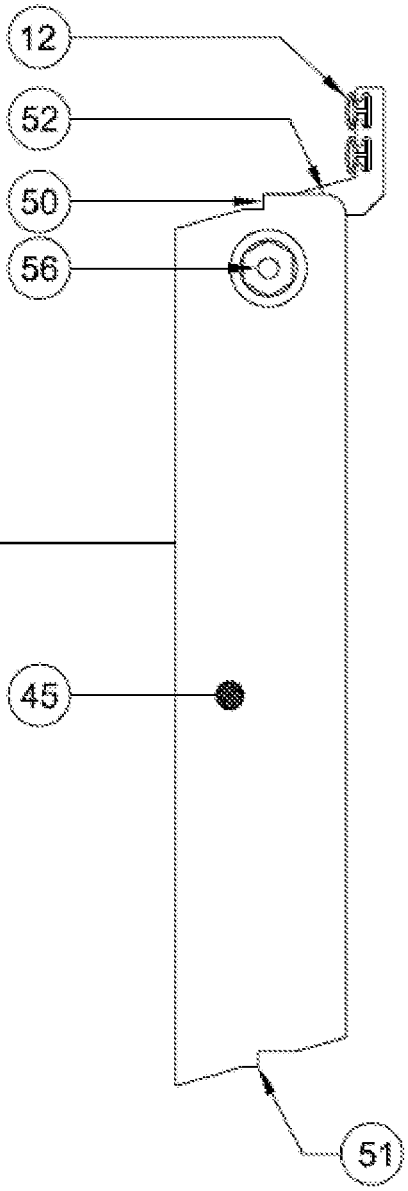
FIG. 10 is an exemplary right-side view of the louver's structure of the first preferred embodiment in accordance with the principles of the present invention.
Figure 11:
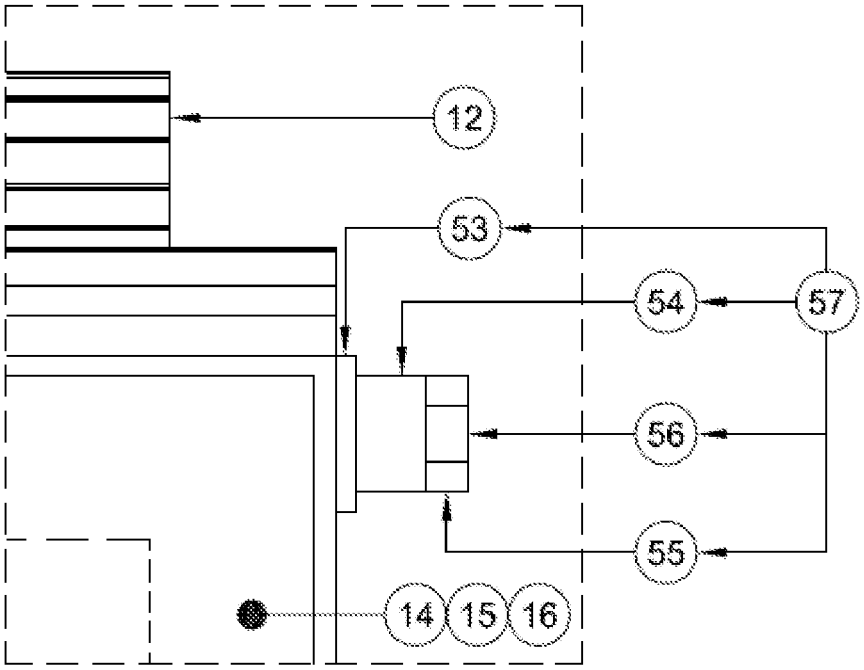
FIG. 11 is an exemplary exploded view of the louver's attachment of the first preferred embodiment in accordance with the principles of the present invention.

FIGS. 9 and 10 are directed to the main frame sides 32, 45. Each main frame side 32, 45 comprises at least a louver attachment means 57, which is coupled to the crank 35, wherein said louver attachment means 57 extends from said frame sides 32, 45. FIG. 10 further shows an arc-shaped cut 52 in one end of the of the top louver frame 13, which allows the movement of the slats to open and close them. The arc-shaped cut 52 can also be appreciated in FIG. 12. FIG. 11 is an exploded view of the louver attachment means 57, wherein said attachment means comprises a bushing 53 (which is part of the main frame), bearing section 54, reshaped end 55 and attachment receiving element 56. The reshaped end 55 is coupled to the crank 35. The reshaped end 55 is configured to comprise a shape that avoids or assists to limit the rotational movement between the crank's end and the louver attachment mean 57. As mentioned, while one end is fixed to the louver attachment 57 the other end of said crank 35 is mechanically coupled to the travel bar 36.

Figure 12:
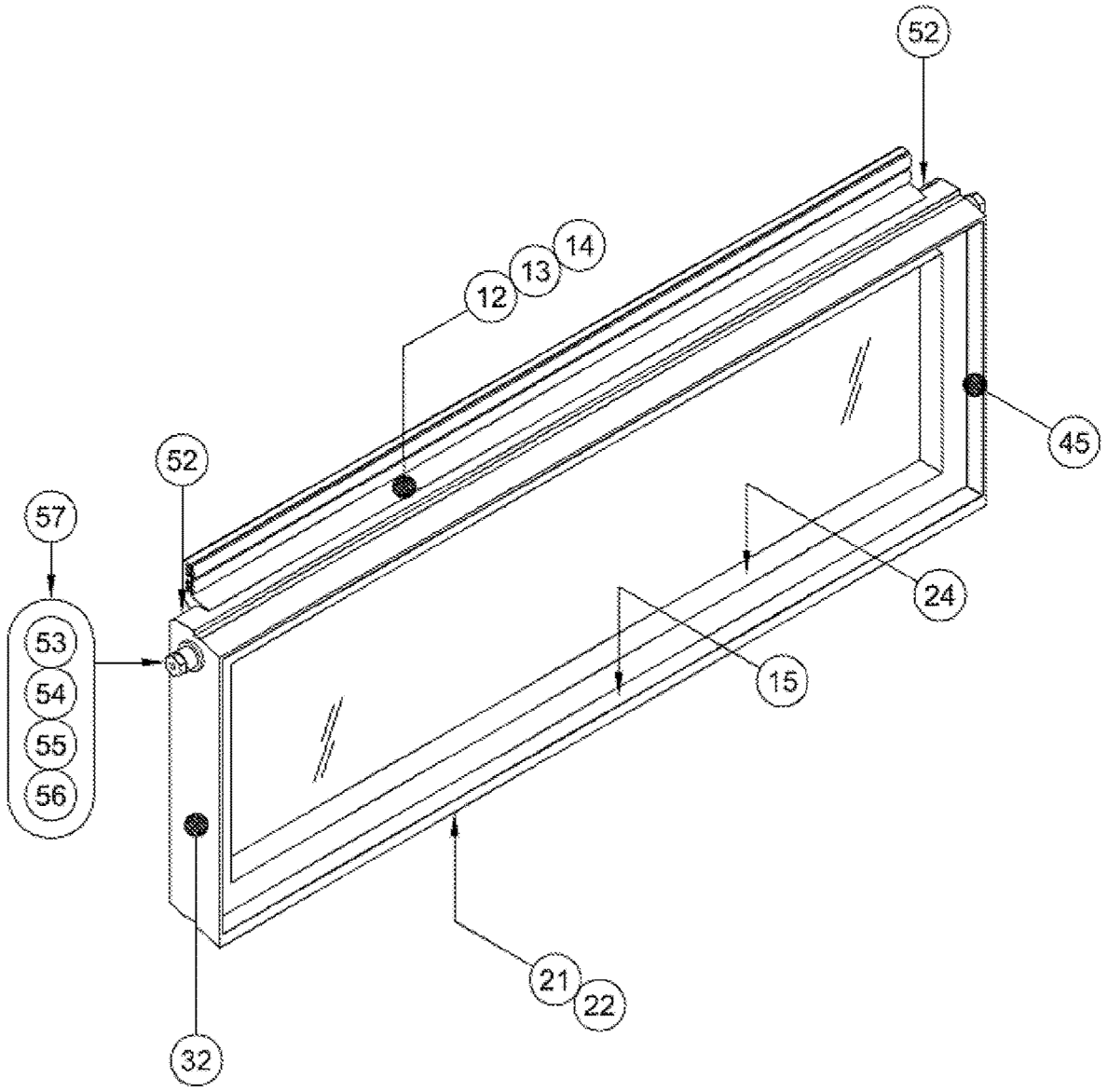
FIG. 12 is an exemplary isometric view of the louver's structure of the first preferred embodiment in accordance with the principles of the present invention.

FIG. 12 is directed to a perspective view of the louver 1. In particular, it shows the sealer 12 extended on top of the louver as part of the top lover frame 13. The frame surrounds the first face 15 and second face 16 and the honeycomb is extended inside providing or generating the area for the middle section 24.

In one embodiment, the simple monobloc rolled glass louver design allows (as seen in FIGS. 6-12) avoiding the traditional need to install laminated glass within a separate non-glass framework that contains it. Said framework creates a problem in energy efficiency, acting as a thermal brake. The thickness of laminated glass is thin in individual layers, making it particularly vulnerable to failure at the edges through breakage or pitting, and increasing the glass thickness compromises the overall weight and increases cost.

Figure 13:
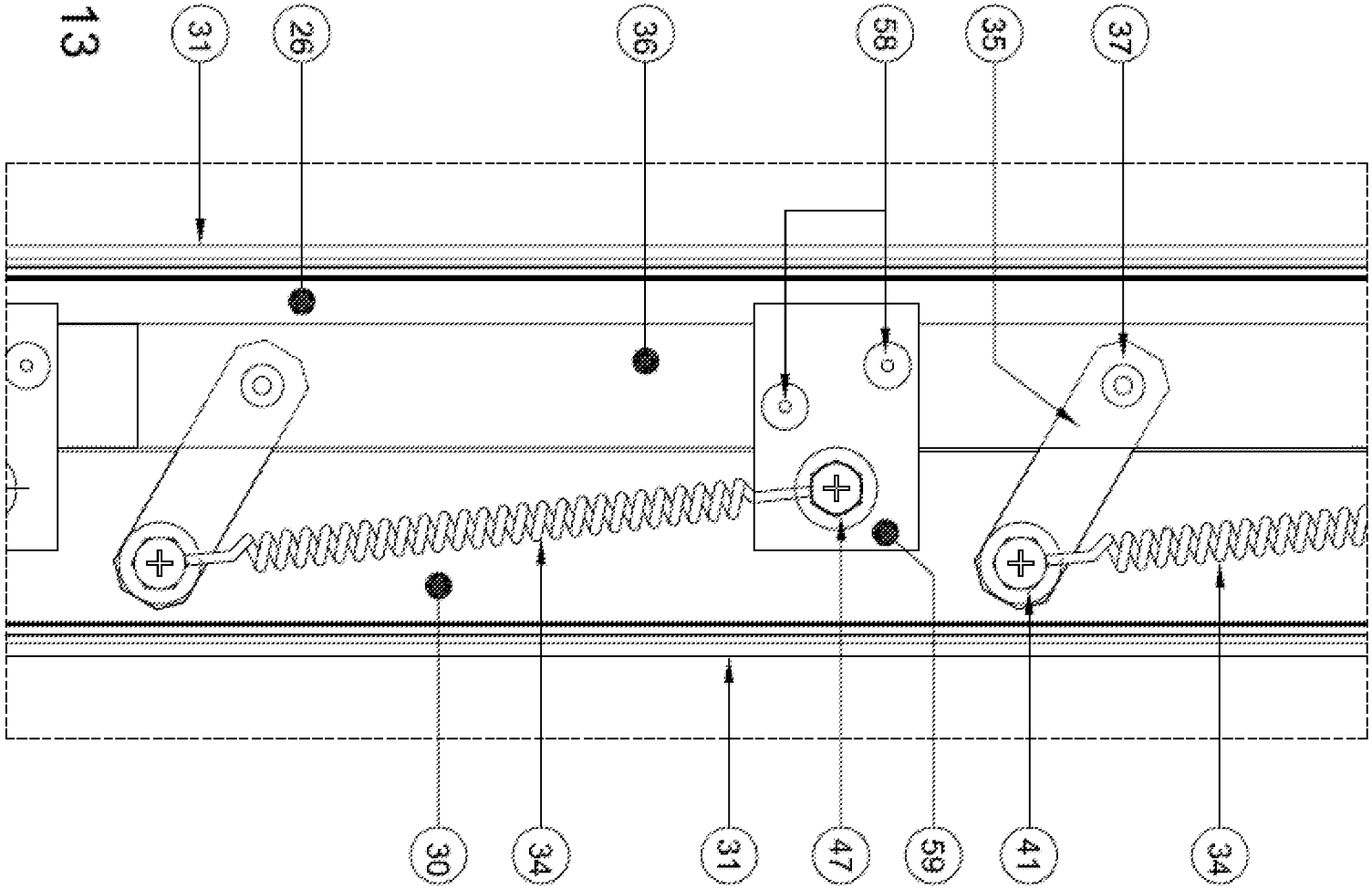
FIG. 13 is an exemplary view of the opening mechanism of the second preferred embodiment in accordance with the principles of the present invention.

FIG. 13 is an exemplary view of the opening mechanism of the second preferred embodiment in accordance with the principles of the present invention. In this embodiment a first end of the spring or elastic member 34 is coupled or connected to the crank 35 at the first attachment member 41 and a second end of the elastic member 34 is coupled to a tension bar 59, which in turn is coupled or connected to the travel bar 36 and to the outer frame 30. The spring or elastic member 34 is connected to the tension bar 59 via the attaching element 47, which may be for example, a rivet, screw or the similar mechanism. The attaching element 47, further connects the tension bar 59 to a lateral side portion of the outer frame 30. Additionally, the tension bar 59 is connected to the travel bar 36 by at least two rivets 58. This embodiment differs from the first in that it creates a different attachment mechanism between the elastic member 34 and the travel bar 36, which in turn provides a stronger fixation between these two elements due to the use of at least two points of support between the travel bar 36 and the tension bar 59. This also provides a different mechanism to equalize the weight of the louvers.

Figure 14:
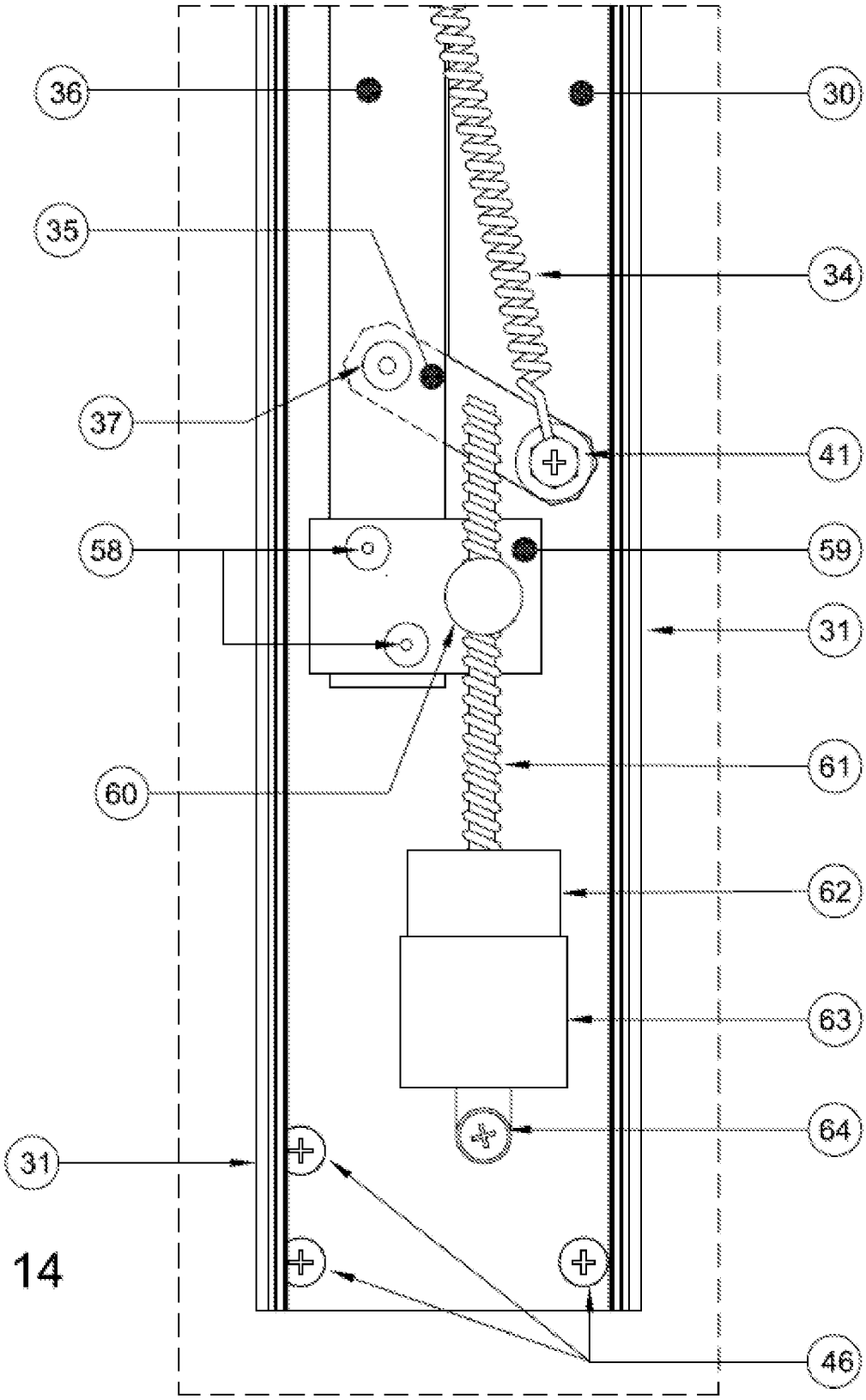
FIG. 14 is an exemplary view of the opening mechanism of the third preferred embodiment in accordance with the principles of the present invention.

FIG. 14 is an exemplary view of the opening mechanism of the third preferred embodiment in accordance with the principles of the present invention. In particular, FIG. 14 shows a motorized operator system which comprises an AC rotary motor 62 inserted or attached to a base 63, the base 63 being fastened or screwed to a lateral side portion the outer frame 30 via rotating element 64. The rotating element 64 may be a screw, or the like. In addition, the AC rotary motor 62 is coupled to a thick threaded screw 61 that interacts with a nut 60. The nut 60, in turn, is coupled or connected to the tension bar 59. When the AC rotary motor 62 is in operation, the threaded screw 61 rotates inside the nut 60 and causes the tension bar 59 to move up or down along the travel bar 36 to open or close the louver. It should also be noted that the tension bar 59 is connected to the travel bar 36 by at least two rivets 58.

Additional features may be included to the system such as, add-on Wireless Smart windows (including interface to Apps), alarms, security cameras, daylight control (using electro chromatic glass). Sound may be reduced through auto reactive acoustic properties, in order to detect undesirable sonic levels (as a default), closing windows blocking the sound depending on physical location (say urban and/or near school locations), climate control (e.g. rain, wind, etc.), dynamic ventilation control (where windows open and close independently maximizing ventilation and regulating dwelling temperature). In one embodiment, the windows may react in case of fire, temperature and smoke management (whether automatic or under fire department control), to improve the chances of escape and survival. This would potentially improve Green building scores.

The different elements of the system mentioned above may be comprised of the following materials: aluminum, plastic, polycarbonate material, titanium oxide crystals (biodegradation of dirt), electro chromatic glass (regulates transparency), shielded glassware (to provide bullet or terrorism protection). In another embodiment, the louver glass may have a translucent photovoltaic skin.

The above systems illustrates integrated operator Shifter (be it manual, assisted manual/automatic clutch system), process thermodynamics and shutters, monobloc laminated glass manufacturing process of high impact resistance louvers), Thermal break honey comb (having thermal applications to either conduction or convection) through either structural or sonic barriers; solid rock fire escape egress windows (resistant to vandalism, impact, explosion, sound, theft and winds.

The system also is envisioned to have windows with auto reactive acoustic properties capable of detecting undesirable sonic levels as a default and reacting by closing windows blocking the sound depending on your location. In addition, in case of fire, smoke or temperature management which would improve the chances of escape and survival.

In concluding the detailed description, it should be noted that it would be obvious to those skilled in the art that many variations and modifications can be made to the preferred embodiment without substantially departing from the principles of the present invention. Also, such variations and modifications are intended to be included herein within the scope of the present invention as set forth in the appended claims. Further, in the claims hereafter, the structures, materials, acts and equivalents of all means or step-plus function elements are intended to include any structure, materials or acts for performing their cited functions. It should be emphasized that the above-described embodiments of the present invention, particularly any "preferred embodiments" are merely possible examples of the implementations, merely set forth for a clear understanding of the principles of the invention. Any variations and modifications may be made to the above-described embodiments of the invention without departing substantially from the spirit of the principles of the invention. All such modifications and variations are intended to be included herein within the scope of the disclosure and present invention and protected by the following claims.

The present invention has been described in sufficient detail with a certain degree of particularity. The utilities thereof are appreciated by those skilled in the art. It is understood to those skilled in the art that the present disclosure of embodiments has been made by way of examples only and that numerous changes in the arrangement. And combination of parts may be resorted without departing from the spirit and scope of the invention as claimed. Accordingly, the scope of the present invention is defined by the appended claims rather than the forgoing description of embodiments.

What is claimed is:

1. A louver operational system comprising:

a crank;

a travel bar;

at least one elastic member;

a transmitter bar;

a tension bar;

and a louver;

wherein the louvre comprises a frame having a first attachment member;

wherein a first end of the crank is coupled to the frame with a first screw via the first attachment member and a second end of the crank is coupled to the travel bar with a rivet;

wherein a first end of the at least one elastic member is coupled to the crank and the frame with the first screw via the first attachment member and wherein a second end of the at least one elastic member is coupled to the tension bar with a second screw;

wherein a first end of the tension bar is connected to the travel bar via at least two rivets and a second end of the tension bar is coupled to the frame via the second screw;

wherein the connection of the tension bar with the travel bar and the frame allows the louver to bias towards a closed and sealed position and to bias in an opposite direction to counteract the weight of the louver when the louver is in an open position;

wherein the frame of the louver comprises:

a top louver frame part including a first seal interlocking configuration;

a bottom louver frame part including a second seal interlocking configuration, wherein said first seal interlocking configuration corresponds to said second seal interlocking configuration, a first side louver frame part comprising the first attachment member, wherein said first attachment element extends away from the first side louver frame part;

a second side louver frame part comprising a second attachment element, wherein said second attachment element extends away from the second side louver frame part;

an impact absorbing structure integrally connected to and disposed within the frame, wherein said impact absorbing structure extends inside the frame;

a first louver face structure comprising an inner layer;

a second louver face structure;

wherein said first louver face structure is surrounded by the frame;

wherein said second louver face structure is surrounded by the frame; and wherein said impact absorbing structure is located between said first louver face structure and said second louver face structure.

2. The louver operational system as in claim 1, wherein said impact absorbing structure is made of a polycarbonate material.

3. The louver operational system as in claim 1, wherein the frame is manufactured from a material selected from the group consisting of:

aluminum, plastic, polycarbonate, titanium oxide crystals, electro-chromatic glass and shielded glassware.

4. The louver operational system as in claim 1, further comprising a housing for the louver operational system that includes a top part, a first side part, a second side part and a bottom part.

5. The louver operational system as in claim 4, wherein said top part comprises at least one sealing element.

6. The louver operational system as in claim 4, wherein said bottom part comprises at least one sealing element.

7. The louver operational system as in claim 1, wherein said frame is an integrally formed structure.

8. A louver operational system comprising:

a crank;

a travel bar;

at least one elastic member;

a transmitter bar;

an AC rotary motor;

a tension bar;

a nut coupled to the tension bar;

and a louver;

wherein the louver comprises a frame having a first attachment member wherein a first end of the crank is coupled to the frame with a first screw via the first attachment member and a second end of the crank is coupled to the travel bar with a rivet;

wherein a first end of the at least one elastic member is coupled to the crank and the frame with the first screw via the first attachment member and wherein a second end of the at least one elastic member is coupled to the travel bar with a second screw;

wherein a first end of the tension bar is connected to the travel bar via at least two rivets and a second end of the tension bar is coupled to the frame via the second screw;

wherein the AC rotary motor is attached to a base that is coupled to the frame;

wherein the AC rotary motor is coupled to a threaded screw that is configured to interact with the nut;

wherein operation of the AC rotary motor causes the threaded screw to rotate inside the nut and allows the tension bar to move in one direction along the travel bar to open the louver and to move in the opposite direction along the travel bar to close the louver;

wherein the frame of the louver comprises:

a top louver frame part including a first seal interlocking configuration;

a bottom louver frame part including a second seal interlocking configuration, wherein said first seal interlocking configuration corresponds to said second seal interlocking configuration, a first side louver frame part comprising the first attachment member, wherein said first attachment element extends away from the first side louver frame part;

a second side louver frame part comprising a second attachment element, wherein said second attachment element extends away from the second side louver frame part;

an impact absorbing structure integrally connected to and disposed within the frame, wherein said impact absorbing structure extends inside the frame;

a first louver face structure comprising an inner layer;

a second louver face structure;

wherein said first louver face structure is surrounded by the frame;

wherein said second louver face structure is surrounded by the frame; and wherein said impact absorbing structure is located between said first louver face structure and said second louver face structure.

9. The louver operational system as in claim 8, further comprising a housing for the louver operational system that includes a top part, a first side part, a second side part and a bottom part.

10. The louver operational system as in claim 9, wherein said top part comprises at least one sealing element.

11. The louver operational system as in claim 9, wherein said bottom part comprises at least one sealing element.

12. The louver operational system as in claim 8, wherein said frame is an integrally formed structure.

* * * * *